US007300540B2

(12) United States Patent
Sabourin et al.

(10) Patent No.: US 7,300,540 B2
(45) Date of Patent: Nov. 27, 2007

(54) ENERGY EFFICIENT TMP REFINING OF DESTRUCTURED CHIPS

(75) Inventors: Marc J. Sabourin, Huber Heights, OH (US); Luc Gingras, Lake Oswego, OR (US)

(73) Assignee: Andritz Inc., Glens Falls, NY (US)

( * ) Notice: Subject to any disclaimer, the term of this patent is extended or adjusted under 35 U.S.C. 154(b) by 377 days.

(21) Appl. No.: 10/888,135

(22) Filed: Jul. 8, 2004

(65) Prior Publication Data

US 2006/0006264 A1 Jan. 12, 2006

(51) Int. Cl.
*D21D 1/30* (2006.01)
*B02C 7/02* (2006.01)
*B02C 7/12* (2006.01)

(52) U.S. Cl. ..... 162/23; 162/18; 162/28; 162/56; 162/68; 241/28; 241/261.3; 241/296

(58) Field of Classification Search ..... 162/13, 162/18, 23, 28, 56, 68; 241/28, 261.2, 261.3, 241/296, 298

See application file for complete search history.

(56) References Cited

U.S. PATENT DOCUMENTS 3,098,785 A * 7/1963 Meiler ..... 162/11
3,910,511 A * 10/1975 Leider et al. ..... 241/261.3
4,012,279 A * 3/1977 Selander et al. ..... 162/13
4,023,737 A * 5/1977 Leider et al. ..... 241/261.3
4,283,252 A * 8/1981 Reinhall ..... 162/23
4,954,221 A * 9/1990 Reinhall et al. ..... 162/261
5,335,865 A * 8/1994 Kohler et al. ..... 241/28
5,683,048 A * 11/1997 Virving ..... 241/261.2
6,276,622 B1 * 8/2001 Obitz ..... 241/261.3
6,402,071 B1 * 6/2002 Gingras ..... 241/261.2
6,607,153 B1 * 8/2003 Gingras ..... 241/261.3
2004/0118959 A1 6/2004 Virving

FOREIGN PATENT DOCUMENTS

WO WO 2004/009900 A1 1/2004

OTHER PUBLICATIONS

Brochure—"Turbine Segments"—Metzo Paper, date unknown.

* cited by examiner

*Primary Examiner*—Eric Hug
(74) *Attorney, Agent, or Firm*—Alix, Yale & Ristas, LLP

(57) ABSTRACT

A system and method for thermomechanical refining of wood chips comprises preparing the chips for refining by exposing the chips to an environment of steam to soften the chips, compressively destructuring and dewatering the softened chips to a solids consistency above 55 percent, and diluting the destructured and dewatered chips to a consistency in the range of about 30 to 55 percent. The destructuring partially defibrates the material. This diluted material is fed to a rotating disc primary refiner wherein each of the opposed discs has an inner ring pattern of bars and grooves and an outer ring pattern of bars and grooves. The destructured and partially defibrated chips are substantially completely defibrated in the inner ring and the resulting fibers are fibrillated in the outer ring. The compressive destructuring, dewatering, and dilution can all be implemented in one integrated piece of equipment immediately upstream of the primary refiner, and the fiberizing and fibrillating are both achieved between only one set of relatively rotating discs in the primary refiner.

14 Claims, 20 Drawing Sheets

ENERGY EFFICIENT TMP REFINING OF DESTRUCTURED CHIPS

BACKGROUND OF THE INVENTION

The present invention relates to apparatus and method for thermomechanical pulping of lignocellulosic material, particularly wood chips.

In recent decades, the quality of mechanical pulp produced by thermomechanical pulping (TMP) techniques has been improving, but the rising cost of energy for these energy-intensive techniques imposes even greater incentives for energy efficiency while maintaining quality. The present inventor has already advanced the state of the art as embodied in the Andritz RTS™, RT Pressafiner™, and RT Fibration™, process technologies. He discovered an operating window by which feed material is preheated for a very short residence time at high temperature and pressure, then refined at such high temperature and pressure between opposed discs rotating at high speed. (U.S. Pat. No. 5,776,305). A further improvement was directed to pretreating the feed chips before preheating, by conditioning in a pressurized steam environment and compressing the conditioned chips in the pressurized steam environment. (PCT/US98/14718). Yet another improvement is disclosed in International Application PCT/US2003/022057, where the feed chips discharged from the pretreatment step, are fiberized without fibrillation, for example with a low intensity refiner, before delivery to a high intensity refiner.

The underlying principle in the progression of the foregoing developments has been to distinguish and handle in distinct equipment, the axial fiber separation and fiberization of the chip material, from the fibrillation of the fibers to produce pulp. The former steps are performed in dedicated equipment upstream of the refiner, using low energy consumption that matches the relatively low degree of working and fiber separation, while the high energy consuming refiner is relieved of the energy-inefficient defibering function and can devote all the energy more efficiently to the fibrillation function. This is necessary since the fibrillation function requires even more energy than defibering (also known as defibration)

These developments did indeed improve energy efficiency, especially in systems that employ high-speed discs (i.e., above 1500 rpm for double disc and above 1800 rpm for single disc refiners). However, especially for systems that did not employ high-speed refiners, the long-term energy efficiency was offset to some extent in the short term by the need for more costly or more space-occupying equipment upstream of the primary refiner.

SUMMARY OF THE INVENTION

The object of the invention is to provide a simplified system and method for producing high quality thermomechanical pulps at lower energy consumption. The simplification includes facilitating the supply of lower cost systems capable of accelerated commissioning and start-up.

In essence, the invention achieves significant energy efficiency, even in systems that do not employ a high speed refiner, while reducing the scope and complexity of the equipment needed upstream of the refiner.

This object is achieved by synthesizing the concepts underlying the RTS, RT Pressafiner, and RT Fibration process technologies, and using a simplified equipment train. The equipment for implementing the invention requires only a pressurized screw discharger (PSD) and refiner(s). Significant modifications, however, are required to the PSD and the associated refining process.

The PSD is of the destructuring variety (macerating pressurized screw discharger, or MPSD) with increasing root diameter and plug zone complete with blowback valve (BBV). MPSD inlet pressure may span from atmospheric to about 30 psig, preferably 5-25 psig. This component of the process simulates RT Pressafiner pretreatment.

Higher dilution flow is necessary to maintain nominal refining consistencies, since the MPSD dewaters to higher solids content than conventional PSD screws.

Fiberizing inner plates (inner rings) in the primary refiner are designed to effectively feed and fiberize destructured wood chips. This component of the process is used to simulate RT Fibration.

High-efficiency outer plates (outer rings) in the primary refiner are designed for feeding (high intensity=>minimum energy consumption) or restraining (low intensity=>maximum strength development), or intensity levels between the two extremes, depending on product quality and energy requirements.

In a broad aspect, the invention is directed to a method for thermomechanical refining of wood chips comprising exposing the chips to an environment of steam to soften the chips, macerating and partially defibrating the softened chips in a compression device, feeding the destructured and partially defibrated chips to a rotating disc primary refiner, wherein opposed discs each have an inner ring pattern of bars and grooves and an outer ring pattern of bars and grooves, a substantially completing fiberization (defibration) of the chips in the inner ring and fibrillating the resulting fibers in the outer ring.

The system implementation preferably includes an inner feeding region and an outer working region on the inner ring and an inner feeding region and an outer working region on the outer ring, wherein the working region of the inner ring is defined by a first pattern of alternating bars and grooves, and the feeding region of the outer ring is defined by a second pattern of alternating bars and grooves. The first pattern on the working region on the inner ring has relatively narrower grooves than the grooves of the second pattern on the feeding region on the outer ring. The fiberization of the chips is substantially completed in the working region of the inner ring with low intensity refining, while the fibrillation of the fibers is performed in the working region of the outer ring at a smaller plate gap and higher refining intensity.

The inventive method preferably comprises the steps of exposing the chips to an environment of steam to soften the chips, compressively destructuring and dewatering the softened chips to a consistency greater than about 55%, diluting the destructured and dewatered chips to a consistency in the range of about 30% to 55%, feeding the diluted destructured chips to a rotating disc refiner, where opposed discs each have an inner ring pattern of bars and grooves and an outer ring pattern of bars and grooves, fiberizing (defibrating) the chips in the inner ring, and fibrillating the resulting fibers in the outer ring.

The compressive destructuring, dewatering, and dilution can all be implemented in one integrated piece of equipment immediately upstream of the primary refiner, and the fiberizing and fibrillating are both achieved between only one set of relatively rotating discs in the primary refiner.

The new, simplified TMP refining method, combining a destructuring PSD and fiberizing inner plates, was shown to effectively improve TMP pulp property versus energy relationships relative to conventional TMP pulping.

The method improved the pulp property/energy relationships for three commercially available processes: TMP, RT, and RTS. The RT and RTS refining configurations refer to low retention and higher pressure refining, typically between 75 psig and 95 psig, at standard refiner disc speeds (RT) or higher disc speeds (RTS).

The defibration efficiency of the inner refining zone improved at higher refining pressure. The level of defibration further increased with an increase in refiner disc speed.

Thermomechanical pulps produced with holdback outer rings had higher overall strength properties compared to pulps with expelling outer rings. The latter configuration required less energy to a given freeness and had lower shive content.

The specific energy savings to a given freeness using the inventive method in combination with expelling outer plates was 15%, 22%, and 32% for the TMP, RT, and RTS series, respectively, compared to the control TMP pulps.

Combining the inventive method with bisulfite treatment improved pulp strength properties and significantly increased pulp brightness.

Higher dilution flow effectively compensated for the higher discharge solids exiting the MSD-type PSD. The dilution/impregnation apparatus should ensure thorough penetration of the chips exiting the MPSD. One option is a split dilution strategy that adds dilution to both the MPSD discharge and in-refiner.

In the present context, maceration should be understood as the physical mechanism associated with solid material under compressive shearing forces. Maceration of wood chips in a steam-pressurized screw device or the like, destructures the material without breakage across grain boundaries, resulting in significant but not complete (e.g., up to about 30%) axial separation of the fibers. The majority of the maceration occurs in the plug zone after the flights, but some initial maceration can occur in the flighted section before the plug zone. The restriction in the plug zone can increase compression and maceration to some degree in the earlier flighted section.

Impregnation liquid (water and/or chemicals) is added directly in the expansion region or chamber at the discharge of the macerating screw device such that the liquid uptake into the expanding wood structure is immediate. The destructured wood chips should be sufficiently saturated with liquid such that the refining consistency is in a preferable range for optimum pulp. All or most of the liquid uptake takes place at the discharge of the MPSD as the heavily compressed chips are released. In the alternative embodiment, the dilution liquid is split, with some dilution at the MPSD screw discharge and further dilution introduced between the inner and outer refiner rings. The latter configuration is useful when excessive saturation is observed at the MPSD discharge but additional dilution is beneficial (after the inner rings) to further optimize the fibrillation refining.

As an example but not a limitation, the consistency in the plug-pipe zone is typically in the range of 58%-65%, and in the expansion zone with impregnation/dilution, in the range of about 30%-55%. The material remains at this consistency range through the seal off zone of the BBV (which is not normally a full seal and is thus similar in pressure to the expansion zone), at the exit from the seal off zone, and at the inlet to the refiner ribbon feeder. This is a pressurized environment so vaporization is taking place, but the goal is to target the optimum refining consistency, usually around 35%-55%, as delivered to the refiner feed device for introduction between the refiner plates.

In most cases the bar/grooves in the working zone of the outer rings (fibrillation) must be finer than in the working zone of the inner rings (defibration). To produce a mechanical pulp fiber, the fiber must first be defibrated (separated from the wood structure) and then fibrillated (stripping of fiber wall material). A key feature of this invention is that the working zone of the inner rings primarily defibrates and the working zone of the outer rings primarily fibrillates. A significant aspect of the novelty of the invention is maximizing the separation of these two mechanisms in a single machine and by that more effectively optimizing the fiber length and pulp property versus energy relationships. Since defibration in the inner rings takes place on relatively large destructured chips, the associated working region pattern of bars and grooves cannot be too fine. Otherwise the destructured chips would not adequately pass through the grooves of the inner rings and be distributed evenly. The defibrated material as received in the outer ring feed region from the inner ring and distributed to the outer ring working region, is relatively smaller and thus the pattern of bars and grooves in the working region of the outer ring is finer than in the inner ring. Another benefit of the invention is that more even distribution (i.e., higher fiber coverage across refiner plates) occurs both in the inner rings and outer rings compared to conventional processes. Better feeding means better feed stability, which decreases refiner load swings, which in turn helps maintain more uniform pulp quality.

An important benefit of the present invention is that the retention time is minimized at each functional step of the process. This is possible because the fibrous material is sufficiently size reduced at each step in the process such that the operating pressures can almost instantaneously heat and soften the fiber to the required level. The process can be considered as having three functional steps: (1) producing destructured chips, (2) defibrating the destructured chips, and (3) fibrillating the defibrated material. The equipment configuration should establish minimum retention time from the MPSD discharge of step (1) to the refiner inlet. The refiner feed device (e.g., ribbon feeder or side entry feeder) operates almost instantaneously for initiating step (2) in the inner rings. The inner ring design should establish a retention time for the material to pass through uninhibited. Some inner ring designs may have longer residence than others to effectively defibrate, but the net retention time is still less than if fibration were performed in a separate component. The defibrated material passes almost instantaneously to the outer ring where step (3) is achieved. Here also, the retention time is low. The actual retention time in the outer ring will be dictated by the design of plates chosen to optimize pulp properties and energy consumption. The benefit of this very low retention (minimum) at each process step (while achieving necessary fiber softening for maintaining pulp strength properties) is maximum optical properties.

In the system described in my prior International Application PCT/052003/022057, wherein the destructured chips were defibrated in a smaller fiberizer refiner before delivery to the main, primary refiner for fibrillation, the pressures were much lower in the fiberizing (defibration) step. The fiberizing retention time at pressure was much longer in a completely separate refiner. It was desirable to maintain a lower temperature to help preserve pulp brightness, since the low intensity refining intensity was gentle. High temperatures were therefore neither necessary nor desirable in the separate fiberizing refiner to preserve pulp strength. In the present invention, defibration and fibrillation are performed within the same highly pressurized refiner casing. The refining intensity in the fiberizing (defibrating) inner ring is still low, achieved at high pressure and a low retention time. There is no negative impact on brightness despite the high pressure (temperature), because the retention time is so short. This is analogous to the surprisingly beneficial effect of low preheat retention time at high temperature as described in my U.S. Pat. No. 5,776,305 (RTS mechanism).

When the present invention is implemented in an RTS system, there is no need for a separate preheat conveyor immediately upstream of the refiner feed device, because the destructured chips heat up rapidly during normal conveyance from the MPSD to the refiner. The environment from the expansion volume or chamber to the rotating discs is the refiner operating pressure, e.g., 75 to 95 psig for RTS, and the "retention time" at the corresponding saturation temperature during conveyance between the MPSD and refiner is well under 10 seconds, preferably in the range of 2-5 seconds, corresponding to the preferred RTS preheat retention time.

More generally, the process advantage of achieving energy efficient production of quality TMP pulp with minimum time at each process step, has the corollary advantage of minimizing the component, space, and cost requirements of equipment for implementing the process. Almost any installed TMP, RT-TMP, or RTS-TMP system can be upgraded according to at least some aspects of the present invention, without increasing the equipment footprint in the mill.

DESCRIPTION OF THE PREFERRED EMBODIMENTS

1. Overview

Figure 1:
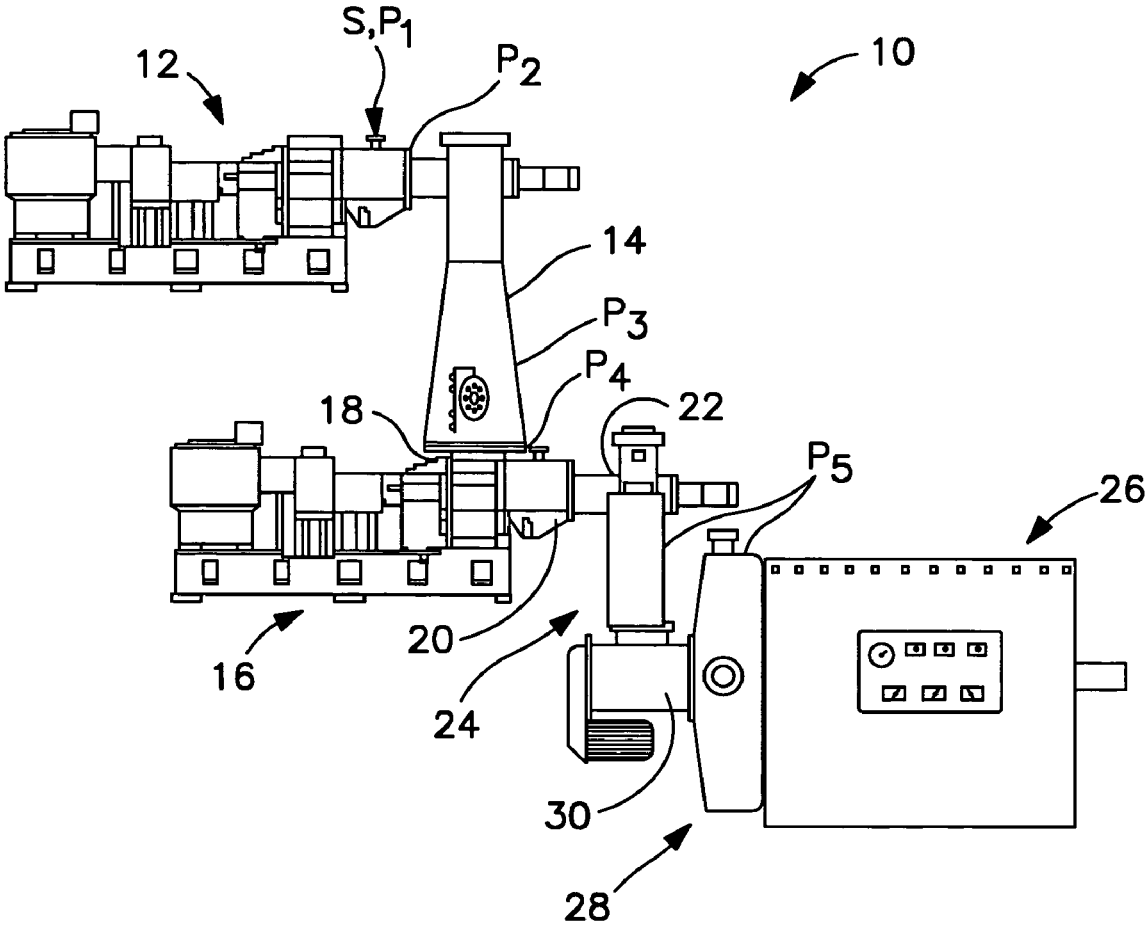
FIG. 1 is a schematic of a TMP refiner system that illustrates an embodiment of the invention.

FIG. 1 shows a TMP refiner system 10 according to the preferred embodiment of the invention. A standard atmospheric inlet plug screw feeder 12 receives presteamed (softened) chips from source S at atmospheric pressure $P_1$=0 psig and delivers pre-steamed wood chips at pressure $P_2$=0 psig to a steam tube 14 where the chips are exposed to an environment of saturated steam at a pressure $P_3$. Depending on the system configuration, the pressure $P_3$ can range from atmospheric to about 15 psig or from 15 to up to about 25 psig with holding times in the range of a few seconds to many minutes. The chips are delivered to a macerating pressurized plug screw discharger (MPSD) 16.

The macerating pressurized plug screw discharger 16 has an inlet end 18 at a pressure $P_4$ in the range of about 5 to 25 psig, for receiving the steamed chips. Preferably, the MPSD has an inlet pressure $P_4$ that is the same as the pressure $P_3$ in the steam tube 14. The MPSD has a working section 20 for subjecting the chips to dewatering and maceration under high mechanical compression forces in an environment of saturated steam, and a discharge end 22 where the macerated, dewatered and compressed chips are discharged as conditioned chips into an expansion zone or chamber at pressure $P_5$ where the conditioned chips expand. Nozzles or similar means are provided for introducing impregnation liquid and dilution water into the discharge end of the screw device, whereby the dilution water penetrates the expanding chips and together with the chips forms a refiner feed material in feed tube 24 having a solids consistency in the range of about 30 to 55 percent. Alternatively, especially if no impregnation apart from dilution is required, the dilution can be achieved in a dilution chamber that is connected to but not necessarily integral with the MSD discharge. In this context, maceration or destructuring of the chips means that axial fiber separation exceeds about 20 percent, but there is no fibrillation.

A high consistency primary refiner 26 has relatively rotating discs in casing 28 that is maintained at pressure $P_5$, each disc, having a working plate thereon, the working plates being arranged in confronting coaxial relation thereby defining a space which extends substantially radially outward from the inner diameter of the discs to the outer diameter of the discs. Each plate has a radially inner ring and a radially outer ring, each ring having a pattern of alternating bars and grooves. The pattern on the inner ring has relatively larger bars and grooves and the pattern on the outer ring has relatively smaller bars and grooves. A refiner feed device 30, such as a ribbon feeder, receives the feed material from the dilution region associated with the MPSD (directly or via an intermediate buffer bin) and delivers the material at pressure $P_5$ to the space between the discs at substantially the inner diameter of the discs. As will be described in greater detail below, the inner ring completes the fiberizing (defibration) of the chip material and the outer ring fibrillates the fibers.

The refiner can be a single disc refiner (one rotating plate faces a stationary stator plate), a double disc refiner (opposed counter-rotating discs), or a Twin disc refiner available from Andritz Inc., Muncy Pa., where a central stator has plates on both sides, and each side faces a rotating disc. The feed devices for a double disc or Twin disc refiner would be somewhat different than that for a single disc refiner, as is known in the relevant field of endeavor.

The system may be backfit into any of the three core processes of (1) typical TMP, (2) RT-TMP, or (3) RTS-TMP. In the typical TMP, the first PSF 12 or rotary valve maintains separation between upstream atmospheric conditions and the elevated pressure in the steam tube that acts as a preheater in the pressure range of about 0-30 psig for a typical hold time of 30 seconds to 180 seconds. As per the invention, the second PSF at the discharge of the steaming tube (typically called a plug screw discharger or PSD) is converted or replaced with an RTPressafiner (macerating pressurized plug screw discharger=MPSD) screw device. In the RT-TMP and RTS-TMP configurations, the first PSF or rotary valve serves essentially the same purpose and the steaming tube can be operated in a range from 0-30 psig. In all configurations the first PSF is not necessary should a mill elect to operate the inlet to the MPSD (RTPressafiner) at atmospheric conditions (0 psig). It is noted that the benefit of pressurizing the inlet during RTPressafiner pretreatment is lost when operating at atmospheric conditions, which can result in fiber damage when processing softwoods using a PSD screw of the destructuring variety. Atmospheric conditions may be satisfactory when processing, for example hardwoods, which have much shorter fiber length to begin with. The typical TMP process is referred to as PRMP when no pressurized presteaming is conducted at the inlet to the MPSD. The material discharging from the MPSD (RTPressafiner) then discharges into the higher temperatures of the refining environment. At RT- or RTS-conditions the refining environment is at a higher temperature, which corresponds to the high pressure (above 75 psig, corresponding to a temperature well above the lignin transition temperature, Tg) in the refiner. In this embodiment, the total time the material is above Tg before delivery to the discs, should be less than 15 seconds, preferably less than 5 seconds.

This can be summarized in the following table:

System Conditions For Invention in Three Backfit Embodiments

| Component Conditions | TMP | RT-TMP | RTS-TMP |
|---|---|---|---|
| Pressure P1 @ chip source S | 0 psig | 0 psig | 0 psig |
| Pressure P2 @ PSF 12 outlet | 0-30 psig | 0-30 psig | 0-30 psig |
| Pressure P3 @ steam tube 14 | 0-30 psig | 0-30 psig | 0-30 psig |
| Holding time steam tube 14 | 30-180 sec | 10-40 sec | 10-40 sec |
| Inlet pressure P4 @ MPSD 16 | 0-30 psig | 0-30 psig | 0-30 psig |
| Processing time in MPSD 16 | <15 sec | <15 sec | <15 sec |
| Pressure P5 @ expansion volume 22, refiner feeder 30 and casing 28 | 30-60 psig | 75-95 psig | 75-95 psig |
| Dwell time in expansion volume 22 refiner feeder 30 and casing 28 | <10 sec | <10 sec | <10 sec |

Figure 2A:
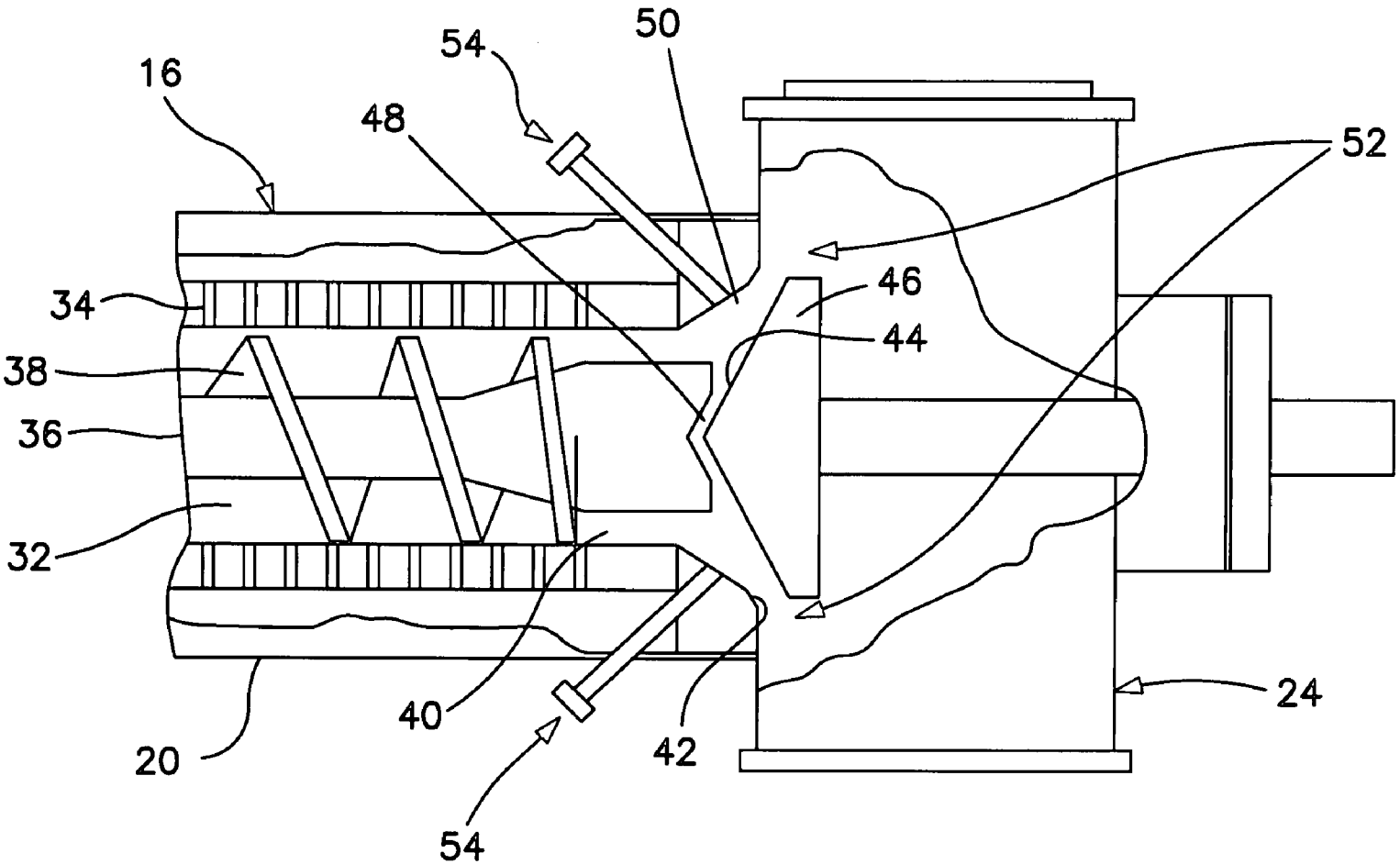
FIGS. 2A and B are schematics of alternatives of a macerating pressurized screw with dilution injection feature, suitable for use with the present invention.

FIGS. 2A and B are schematics of a macerating pressurized screw 16 with dilution injection feature, suitable for use with the present invention. According to the embodiment of FIG. 2A, chip material 32 is shown in the central, dewatering portion of working section 20, where the diameters of the perforated tubular wall 34, rotatable coaxial shaft 36, and flights 38 are constant. A chip plug 40 is formed in the plug portion of the working section, immediately following the dewatering portion, where the wall is imperforate and the shaft has no flights but the shaft diameter increases substantially, producing a narrowed flow cross section and thus a high back pressure that enhances the extrusion of liquid from the chips, through the drain holes formed in the wall of the central portion. The constricted flow and macerating effect may be further enhanced or adjusted by use of a tubular constriction insert (not shown) within the imperforate wall, or rigid pins or the like (not shown) projecting from the wall into the plugged material. The plug is highly compressed under mechanical pressures typically in the range of 1000 psi to 3000 psi, or higher. Most if not all of the maceration occurs in the plug. The chips are substantially fully destructured, with partial defibration exceeding about 20 percent usually approaching 30 percent or more.

At the end of the plug, the discharge end 22 of the MPSD has an increased cross sectional area, defined between an outwardly flared wall 42 and the confronting, spaced conical surface 44 of the blow back valve. 46. The blow back valve is axially adjustable from a stop position nested in a conical recess 48 at the end of the MPSD shaft 36, to a maximum retracted position. This adjusts the flow area of the expansion zone or volume 50 while maintaining a mild degree of sealing at 52 by chip material between the valve against the outer end of the flared wall, which can be controlled in response to transient pressure differential between the feed tube 24 and the MPSD 16.

In the expansion zone 50, impregnating liquor is fed under high pressure either through a plurality of pressure hoses 54 and associated nozzles (as shown), or a pressurized circular ring. The dewatered chips entering the expansion zone 50 quickly absorb the impregnation fluid and expand, helping to form the weak sealing zone at the end of the expansion zone.

Figure 2B:
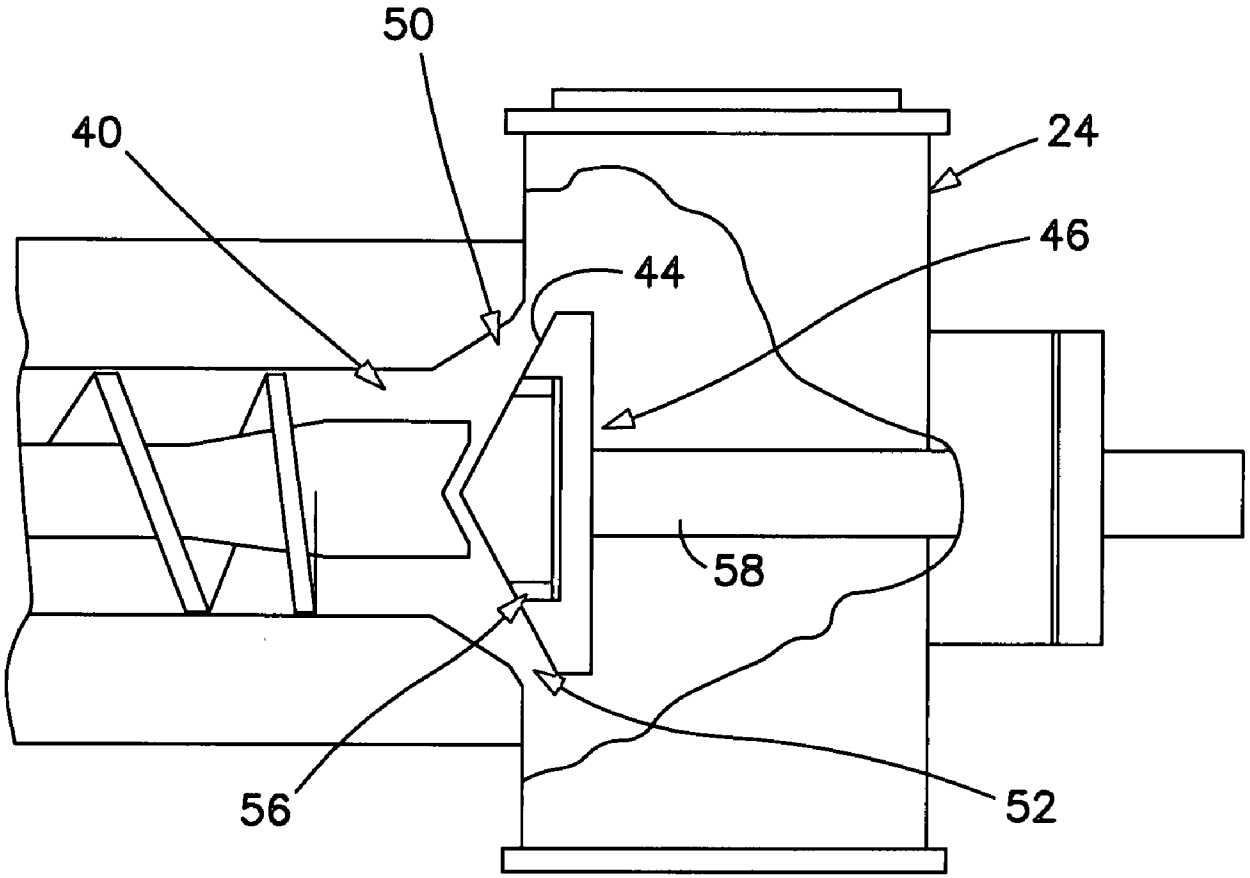

FIG. 2B shows an alternative whereby the impregnation in the expansion zone 50 is achieved by providing fluid flow openings 56 in the face of the conical blow back valve, which can be supplied via high pressure hoses through the shaft 58 of the blow back valve.

The feed tube 24 is preferably a vertical drop tube for directing and mixing the diluted chips from the MPSD 16 to the feed device 30 of the refiner. However, it should be understood that the pressure $P_5$ in the feed tube 24 is the same pressure as in the feed device 30 and refiner casing 28. A small pressure boost or drop may be desired between the refiner feed device 30 and refiner casing 28, which is common practice in the field of TMP. Regardless, the pressures throughout this region following the MPSD to the refiner casing would typically be well above 30 psig, usually above 45 psig, which is much higher than the MPSD inlet steam pressure $P_4$. However, the plug 40 is so highly mechanically compressed that even with the tube pressure as high as 95 psig or more, the compressed plug will quickly expand in the expansion zone due to the expansion of pores in the fibers in the uncompressed state. It can thus be appreciated that the feed tube can act as an expansion chamber in contributing to the effectiveness of the expansion volume. Practitioners in this field could readily modify the design and relationship of the expansion zone and feed tube so that expansion and dilution occur predominantly in a dedicated expansion chamber that is attached to but not integral with the MPSD.

Figure 3:
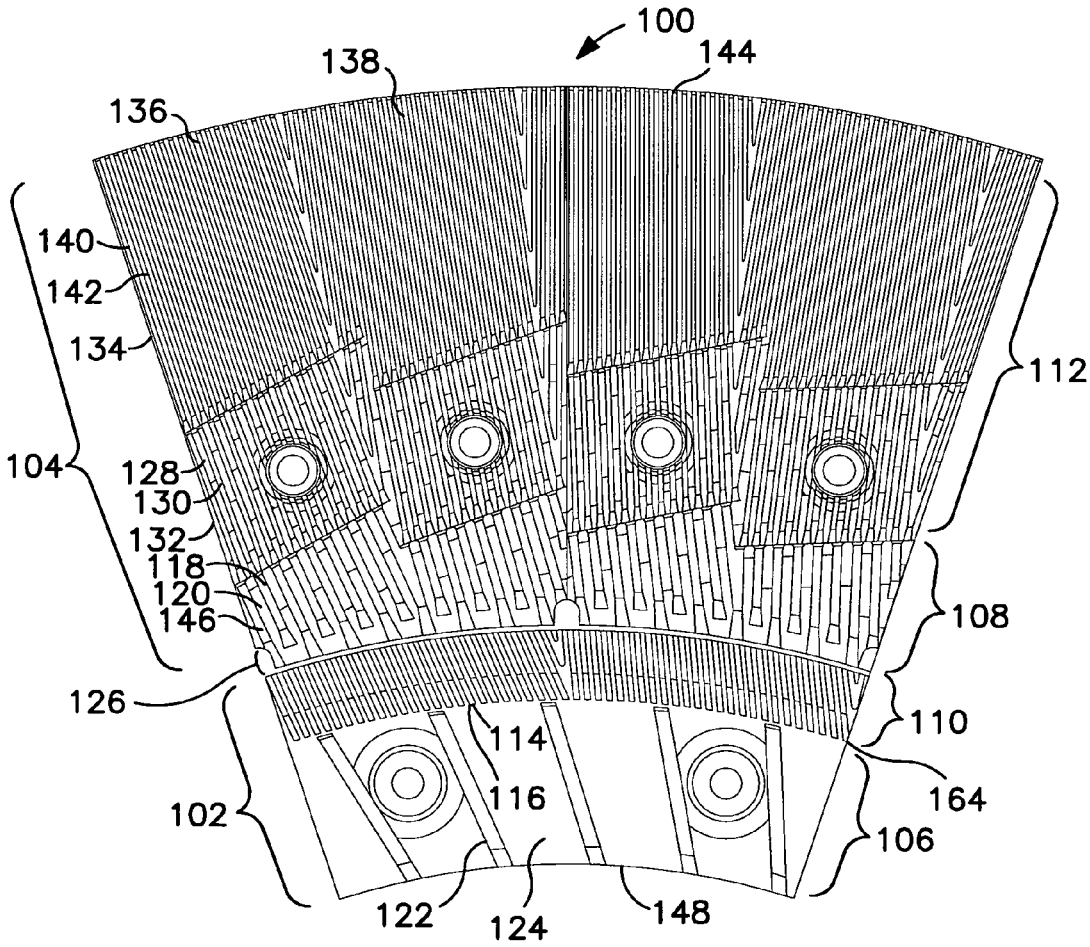
FIG. 3 is a schematic representation of a portion of a refiner disc plate, showing the inner fiberizer ring and the distinct outer fibrillation ring.

FIG. 3 is a schematic representation of a portion of refiner disc plate 100, showing the inner fiberizer ring 102 and the outer fibrillation ring 104. Each ring can be a distinct plate member attachable to the disc, or the rings can be integrally formed on a common base that is attachable to a disc. Each ring has an inner feeding region 106, 108 and an outer working region 110, 112. The working (defibrating) region of the inner ring is defined by a first pattern of alternating bars 114 and grooves 116, and the feeding region of the outer ring is defined by a second pattern of alternating bars 118 and grooves 120. The very course bars 122 and grooves 124 in the feeder region 106 of the inner ring direct the previously destructured chip material into the defibrating region 110 of significantly narrower bars and grooves. The fiberized material then intermixes in and crosses the transition annulus 126, where it is enters the feed region 108 of the outer ring. In general, the first pattern on the working region 110 on the inner ring has relatively narrower grooves than the grooves of the second pattern on the feeding region 108 on the outer ring. The working (fibrillating) region 112 of the outer ring has a pattern of bars 128 and grooves 130 wherein the grooves 130 are narrower than the grooves 116 of the working region 110 of the inner ring.

The coarse bars and grooves of the feeding region 106 of the inner ring on one disc can be juxtaposed with a feeding region on the opposed disc that has no bars and grooves, so long as the shape of the feed flow path readily directs the feed material from the ribbon feeding device into the working regions 110 of the opposed inner rings. Thus, every inner ring 102 will have an outer, fiberizing region 110 with a pattern of alternating bars and grooves 114, 116 but the associated inner region 106 will not necessarily have a pattern of bars and grooves. The outer region 112 of the fibrillating ring 104 can have a plurality of radially sequenced zones, such as 132, 134, and/or a plurality of differing but laterally alternating fields, in a manner that is well known for the "refining zone" in TMP refiners, such as 136, 138. In FIG. 3, the outer ring 104 has an inner, feeding region 108 of alternating bars and grooves, and the working region 112 has a first pattern of alternating bars and grooves 128, 130 appearing as laterally repeating trapezoids in zone 132, and another pattern of alternating bars and grooves 140, 142 appearing as laterally repeating trapezoids in zone 134 that extend to the circumference 144 of the plate.

The annular space 126 between the inner and outer rings 102, 104 can be totally clear, or as shown in FIG. 3, some of the bars such as 146 in the outer ring feed region 108 can extend into the annular space. The annular space 126 delineates the radial dimension of the inner and outer rings, whereby the radial width of the inner ring 102 is less than the radial width of the outer ring 104, preferably less than about 35 percent of the total radius of the plate from the inner edge 148 of the inner ring 102 to the circumferential edge 144 of the outer ring 104. Also, the radial width of the feed region 106 of the inner ring 102 is larger than the radial width of the working region 110 of the inner ring, whereas the radial width of the feed region 108 in the outer ring 104 is less than the radial width of the working region 112.

The type of plate described above with reference to FIG. 3 will for convenience be referred to as an "RTF" plate. The destructured and partially defibrated chip material enters the inner feed region 106 where no substantial further defibration occurs, but the material is fed into the working region 110 where energy-efficient low intensity action of the bars and grooves 114, 116 defibrates substantially all of the material. Such plates can be beneficially used as replacement plates in refiner systems that may not have an associated pressurized macerating discharger. Where a PMSD is present, the combination of full destructuring and partial defibration along with high heat upstream of the refiner allows the plate designer to minimize the radial width and energy usage in the working region 110 of the inner ring for completing defibration. The pattern of bars and grooves 114, 116 and the width of the working region 110 can be varied as to intensity and retention time. Even with less than ideal upstream destructuring and partial defibration, the plate designer can increase the radial width of the inner working zone 110 and chose a pattern that retains the material somewhat for enhanced working, while still achieving satisfactory fibrillation in a shortened high intensity outer ring 112 and overall energy savings for a given quality of primary pulp. Moreover, the invention does not preclude that with the RTF plates, some defibration may occur in the outer ring 104 or some fibrillation may occur in the inner ring 102.

Figure 5:
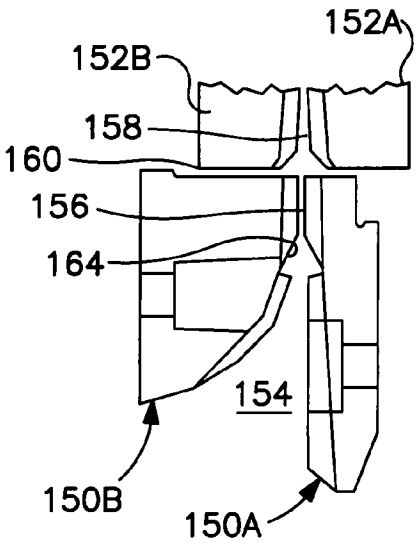
FIG. 5 shows the relationship of the inner, fiberizing ring pair to the outer, fibrillation ring pair, at the transition region.
Figure 4A:
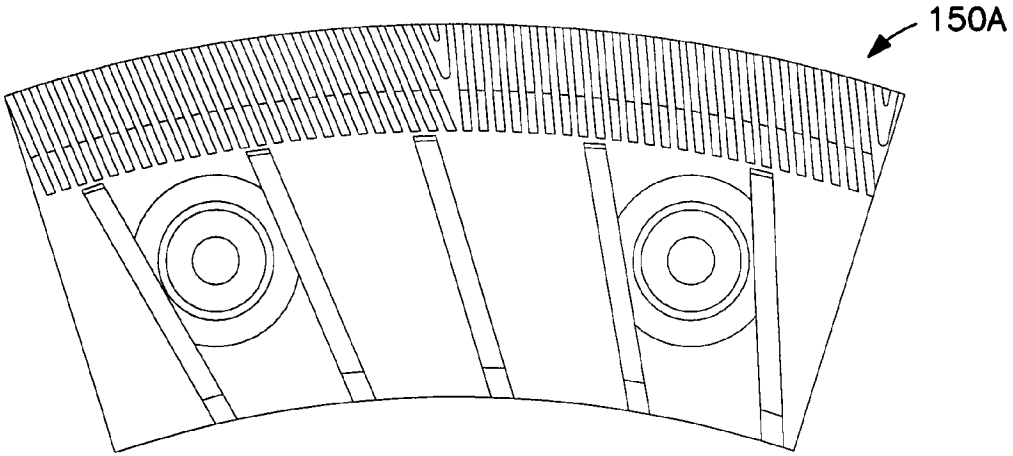
FIGS. 4A and B show an exemplary inner, fiberizing ring pair for the rotor and stator, respectively, having angled bars and grooves.
Figure 4B:
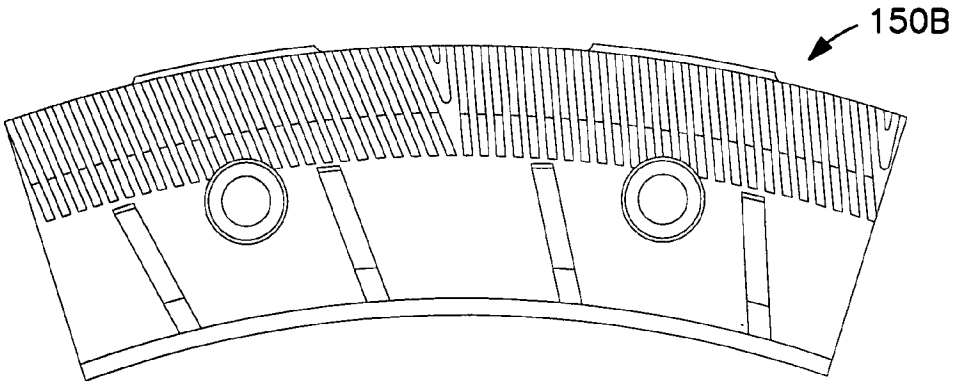
Figure 6A:
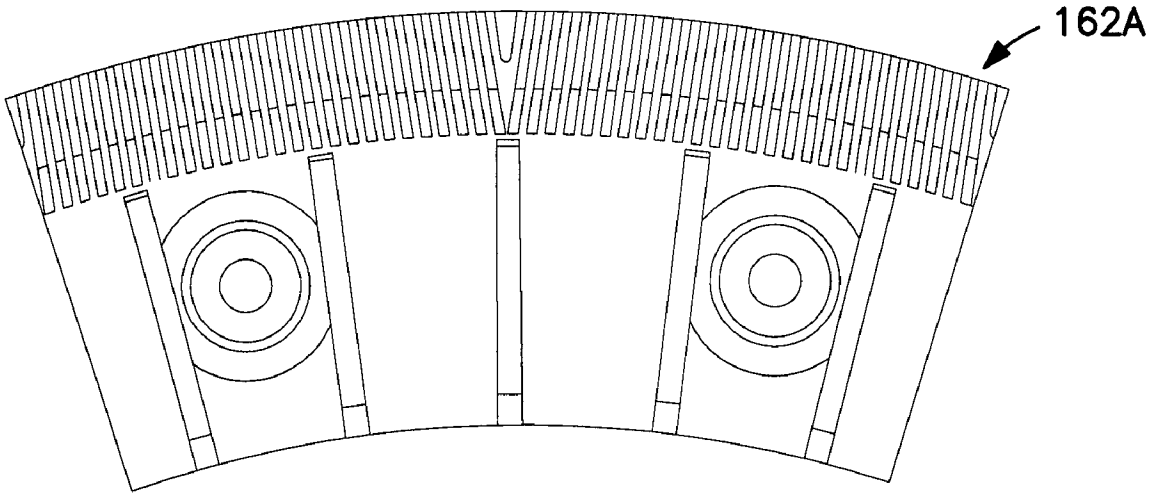
FIGS. 6A and B show another exemplary fiberizing ring pair, having substantially radial bars and grooves.
Figure 6B:
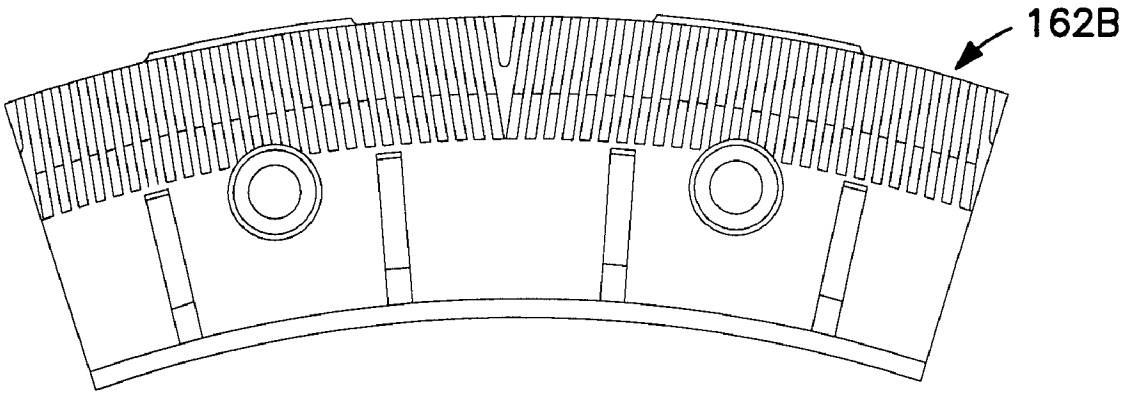
Figure 7C:
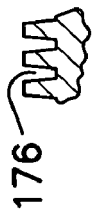
FIGS. 7A and B show an exemplary outer, fibrillating ring, in front and side views, respectively, and FIGS. 7C and D show section views across the bars and grooves in the outer and middle zones, respectively.
Figure 7D:
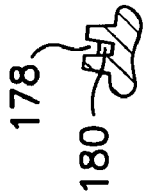
Figure 7A:
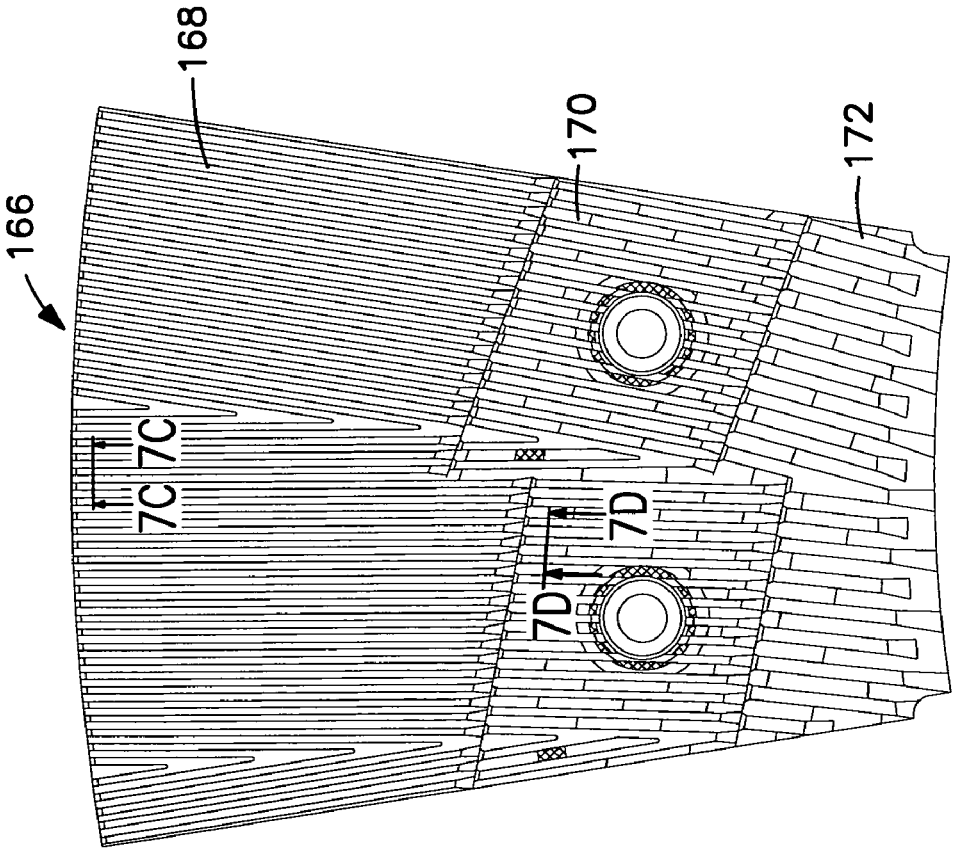
Figure 7B:
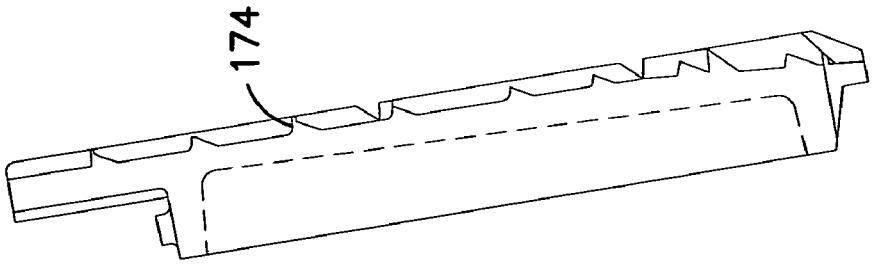

The composite plate shown in FIG. 3 is merely representative. FIGS. 4, and 6 show other possible regions for the inner rings. FIG. 4A shows one inner ring 150A and FIG. 4B shows the opposed inner ring 150B. FIG. 5 shows a schematic juxtaposition of opposed inner rings 150A and 150B, with portions of the associated outer rings 152A and 152B as installed in the refiner. The feed gap 154 of the inner rings is preferably curved to redirect the feed material received at the "eye" of the discs from the axially conveyed direction, toward the radial working gap 156 of the inner rings. Preferably, the feeder bars (very coarse bars) are spaced apart by more than the size of the material in the feed. For example, the smallest of the three dimensions defining the chips (chip thickness) is typically 3-5 mm. This is to avoid severe impact, which results in fiber damage in the wood matrix. In most instances, the minimum gap 154 during operation should be 5 mm. The coarse feeder bars have the sole function of supplying the outer part of the inner ring with adequate feed distribution and should do no work on the chips. The feeder bars are provided on the rotor inner ring, but are not absolutely necessary on the stator inner ring.

In the embodiment of FIG. 4, the bars and grooves in the inner ring are angled relative to the radius, thereby inhibiting free centrifugal flow in the inner ring and increasing retention time, if rotated to the left, or accelerating the flow if rotated to the right. In the embodiment of FIG. 6, inner rings 162A and 162B have a substantially radial orientation that neither inhibits or nor enhances centrifugal flow. As shown in FIGS. 3 and 5, the bars at the inlet of the defibrating region, e.g. the outer region of the inner rings, have a long chamfer 164, or a gradual wedge closing shape. In general, the entrance to the fiberizing gap 156 between the inner rings is radial or near radial (no significantly scattered transition). This also prevents strong impacts on the wood chips. The slope of the chamfer should be typically a drop of 5 mm in height over a radial distance of 15-50 mm. The resulting slope is 1:5 to 1:10, but slopes of 1:3-1:15 with height drop of 3 to 10 mm are acceptable. It is that wedge shape that defines the low intensity "peeling" of chips, as opposed to the high intensity impacts of conventional breaker bars operating at a tight gap. The operating gap 156 in the working region of the inner plate be in the order of 1.5-4.0 mm, and can narrow gently outwardly. If the chamfer 164 is in the lower range of the angle (e.g. 1:3), then a large taper of gap 156 should be used, e.g., at least 1:40. This will ease the feed into the tighter gap.

The short working region 110 should operate at a gap of between 3 and 5 mm when the outer rings are at a standard operating gap. The gap 158 at the inlet of the outer rings should be slightly larger than the gap at the outer part of the inner rings. The outer part of the inner ring is preferably ground with taper, which ranges from flat to approximately 2 degrees, depending on application. Larger tapers and larger operating gaps will reduce the amount of work done in the inner rings. The construction of the outer region of the inner ring is such that it should minimize impact on the feed material in order to preserve fiber length at a maximum, while properly separating fibers.

The groove width in the fibrating region 110 should be smaller than the wood particles, and in order of magnitude of minimum operating gap for the fibrating region. Typically, no groove should be wider than 4 mm wide. This ensures that wood particles are being treated in the gap rather than being wedged between bars and hit by bars from opposing disc.

In the fibrating inner region 110 (or plate inlet for a one-piece refiner plate), the chips are reduced to fibers and fiber bundles before passing through annular space 160 and entering the outer ring 104. That ring can closely resemble known high consistency refiner plate construction. As the fibers are mostly separated, they will not be subjected to high intensity impacts. One can see from FIGS. 3 and 5 that if untreated chips could enter the feeder region 108 of the outer ring, they would be subjected to high intensity impacts when the chip is wedged between two coarse bars 118, 120. If the chips are properly separated in the fibrator inner rings 102, then there are no large particles left, so they cannot be subjected to this type of action.

The division of functionality as between the inner and outer rings can also be implemented in a so-called "conical disc", which has a flat initial refining zone, followed by a conical refining zone within the same refiner. In that case, the inventive fibrating rings would substitute for the flat refining zone, which would then be followed by the conventional "main plate" refining in the conical portion. Normally, a conical portion for such refiners has a 30 or 45 degree angle cone, e.g. it is 15 or 22.5 degrees from a cylindrical surface. An example of such a conical disc refiner is described in U.S. Pat. No. 4,283,016, issued Aug. 11, 1981. Thus, as used herein, "disc" includes "conical disc" and "substantially radially" includes the generally outwardly directed but angled gap of a conical refiner.

The inlet of the outer region of inner ring has a radial transition, or close to radial. Large variation in the radial location of the start of the ground surface normally results in the loss of fiber length, when particles larger than the gap are quickly forced into the gap. With a long chamfer at the start of the region (longer is better), the material fed will be gradually reduced in size until small enough (coarseness reduction) to enter the gap formed by the ground surfaces. The groove width of the outer region of the inner ring has to be narrow enough to prevent large unsupported fiber particles from entering the groove and then be forced into the gap, thus causing fiber cutting. Typically, the groove width should be no wider than the gap at the inlet of the ground surface. Subsurface dams or surface dams can be used in order to increase the efficiency of the action and/or increase energy input in the inner plates.

Two embodiments of the outer, fibrillating ring are shown in FIGS. 7 and 8. These can range from high intensity to very low intensity. For the purpose of illustration of the concept, the pattern of FIG. 7 is a typical example of a high intensity directional outer ring 166. FIG. 8 represents a very low intensity bi-directional design 182. Various other bar/groove configurations can be used, such as having a variable pitch (see U.S. Pat. No. 5,893,525).

The directional ring 166 is coarser and has a forward feeding region 172 which reduces retention time and energy input capability in that area, forcing more energy to be applied in the outer part of the ring, which in turn increases the intensity of the work applied there, and thus will operate at a tighter gap. The working region of the outer ring has two zones 168, 170, the outer 168 of which has finer grooves than the former 170. Some or all of the grooves such as 176 in the zone 168 can define clear channels that are slightly angle to the true radii of the ring, whereas other grooves such as 180 in the other zone 170 can have surface or subsurface dams 174, 178. Overall, the outer ring 166 is similar to the outer ring 112 of FIG. 3.

As another example, the full-length variable pitch pattern 182 of FIG. 8 has essentially radial channels, without any centrifugal feeding angle. The feed region 190 is very short, and the working region 188 can have uniform or alternating groove width, or as shown at 184 and 186, alternating or variable groove depth. This allows for a longer retention time within the plates and, combined with the large number of bar crossings, allows for a low intensity of energy transfer, which results in a larger plate gap.

Figure 8C:
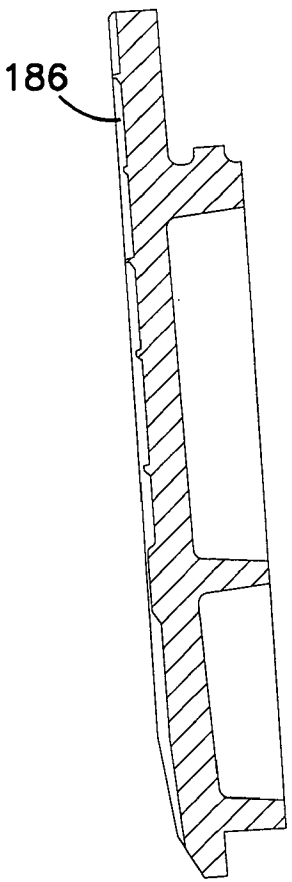
FIGS. 8A, B and C show another exemplary outer, fibrillating ring in front and section views, respectively.
FIG. 8D shows a side and front view, respectively, of an exemplary outer ring for a rotor disc, having curved feeding bars.
FIG. 8E shows a side and front view, respectively, of an exemplary opposing outer ring for a stator, to be employed with the outer ring of FIG. 8D.
Figure 8B:
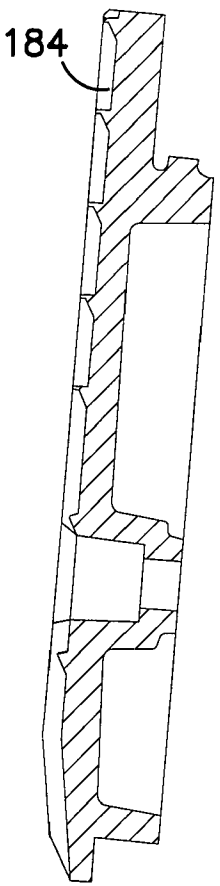
Figure 8A:
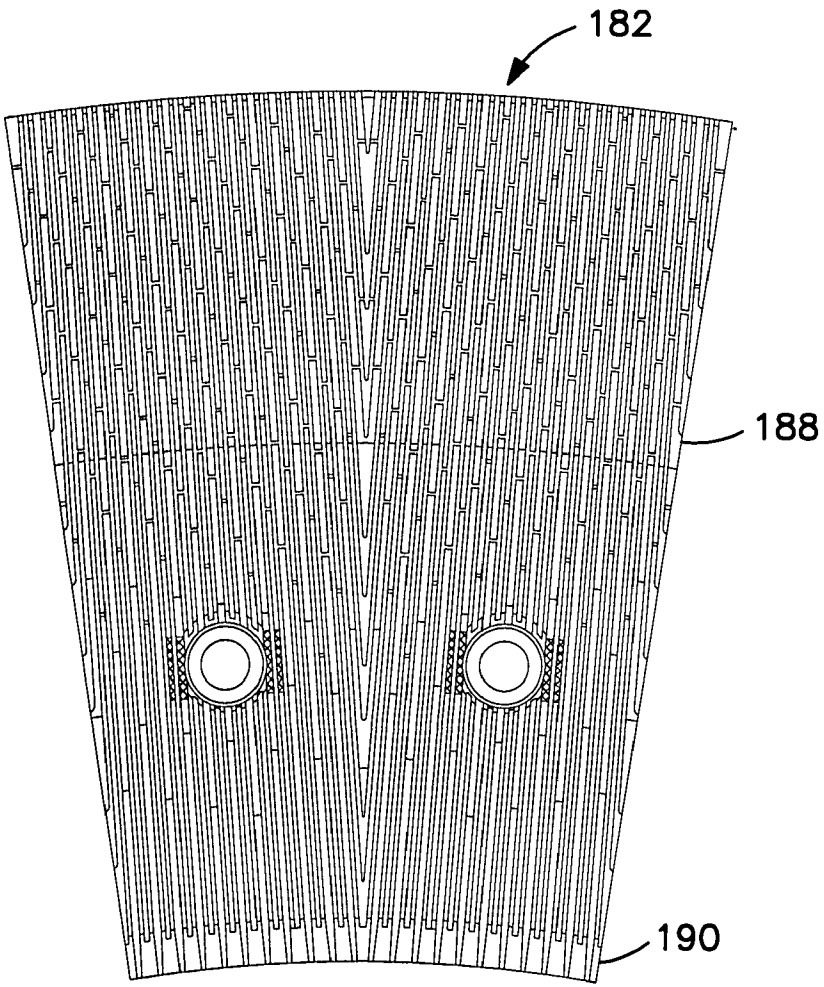
Figure 8D:
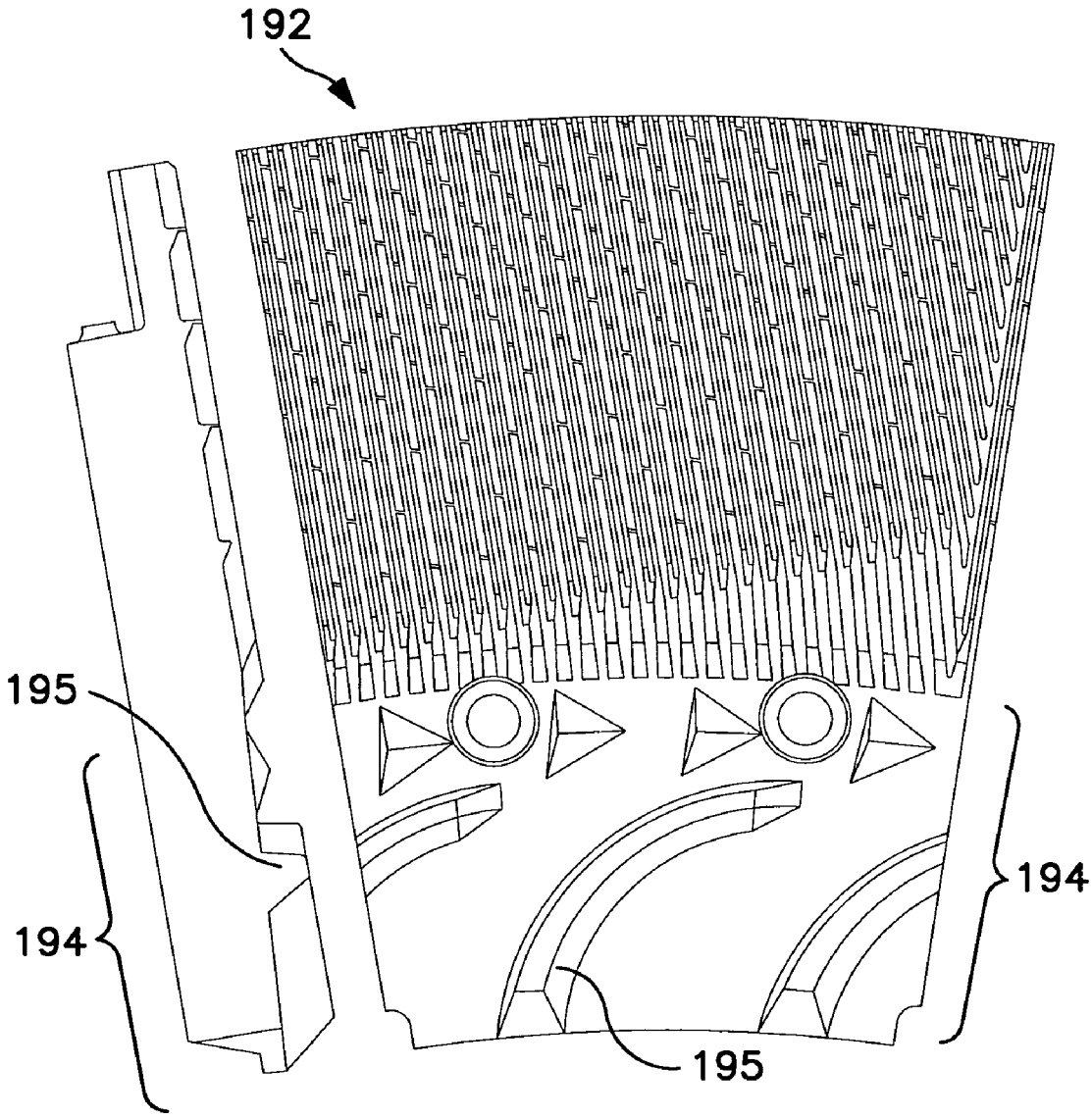
Figure 8E:
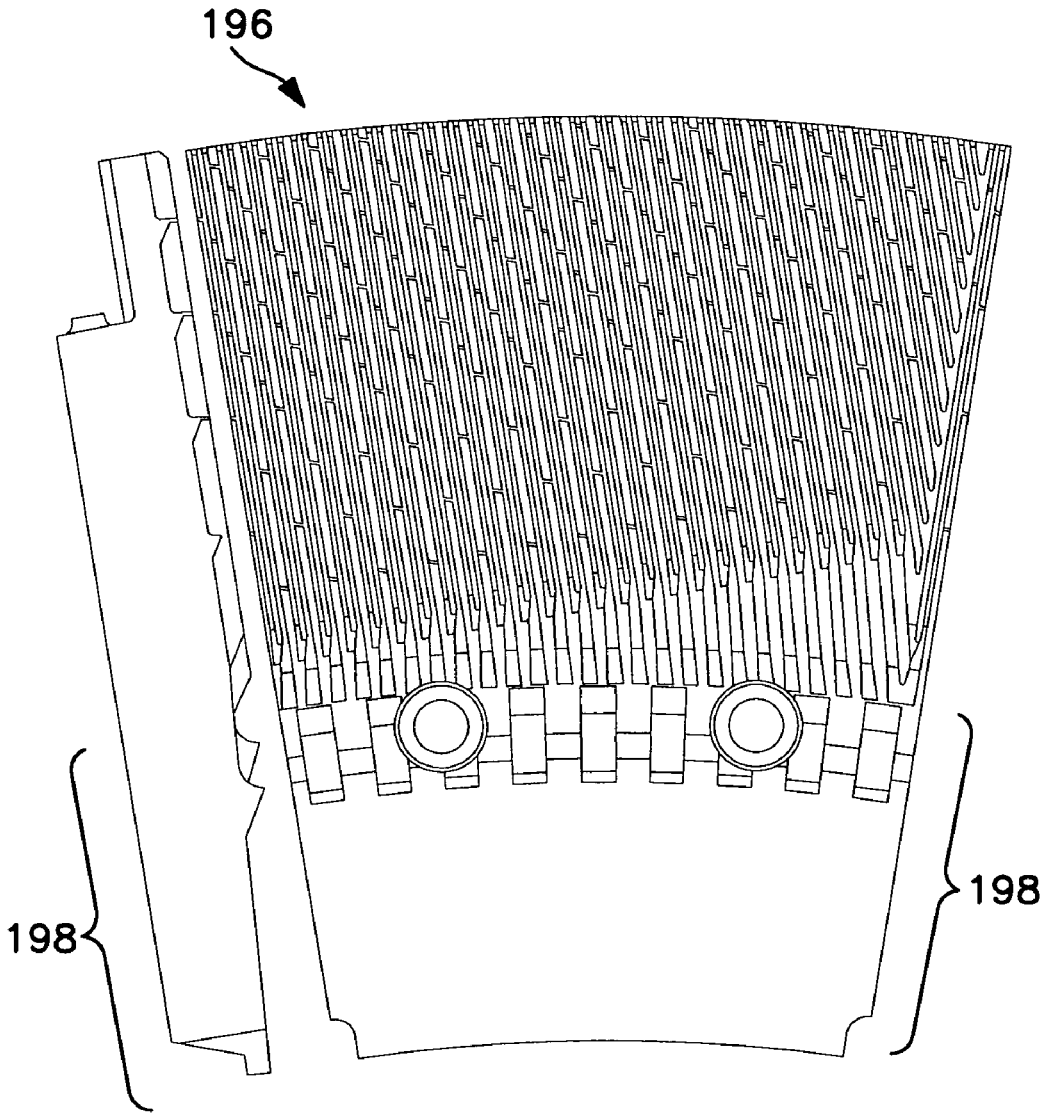

In a variation of the outer ring, the inner feeding region of the outer ring is designed to prevent backflow of fiber from the outer ring to the inner ring. FIG. 8D presents an outer ring 192 for the rotor disc, with a feed region 194 having curved feeding bars 195. The opposing stator ring 196, as illustrated in FIG. 8E, does not have bars in the inner feed region 198 in opposition to the curved bars, thereby accommodating the opposing curved feeding bars 195 on the outer ring 192. Such an approach further ensures a complete separation between the defibration and fibrillation steps in the inner and outer rings, respectively.

As shown in figures, the curved feeding (injector) bars 195 can optionally be supplemented with other structure in the feeding region of the rotor and/or stator rings (such as pyramids and opposed radial bars) to aid in the distribution of material from the curved bars into the working region. Thus, the surface of the radial extent of feed region 194 of the rotor can be fully or partially occupied by projecting curved bars 195 and the surface of the radial extent of the feed region 198 of the stator can be entirely flat, or partially occupied by distribution structure. The curved bars 195 of the rotor ring project in the feed region 194 a distance greater than the height of the bars in the working region, but the flatness of the opposed surface in the feeding region 198 of the stator ring accommodates this greater height.

In general, the pattern of bars and grooves throughout the working region of the inner ring has a has a first average, preferably uniform, density and the pattern of bars and grooves throughout the feed region of the outer ring has a second average, preferably uniform but lower density.

2. Pilot Plant Laboratory Realization

Figure 9:
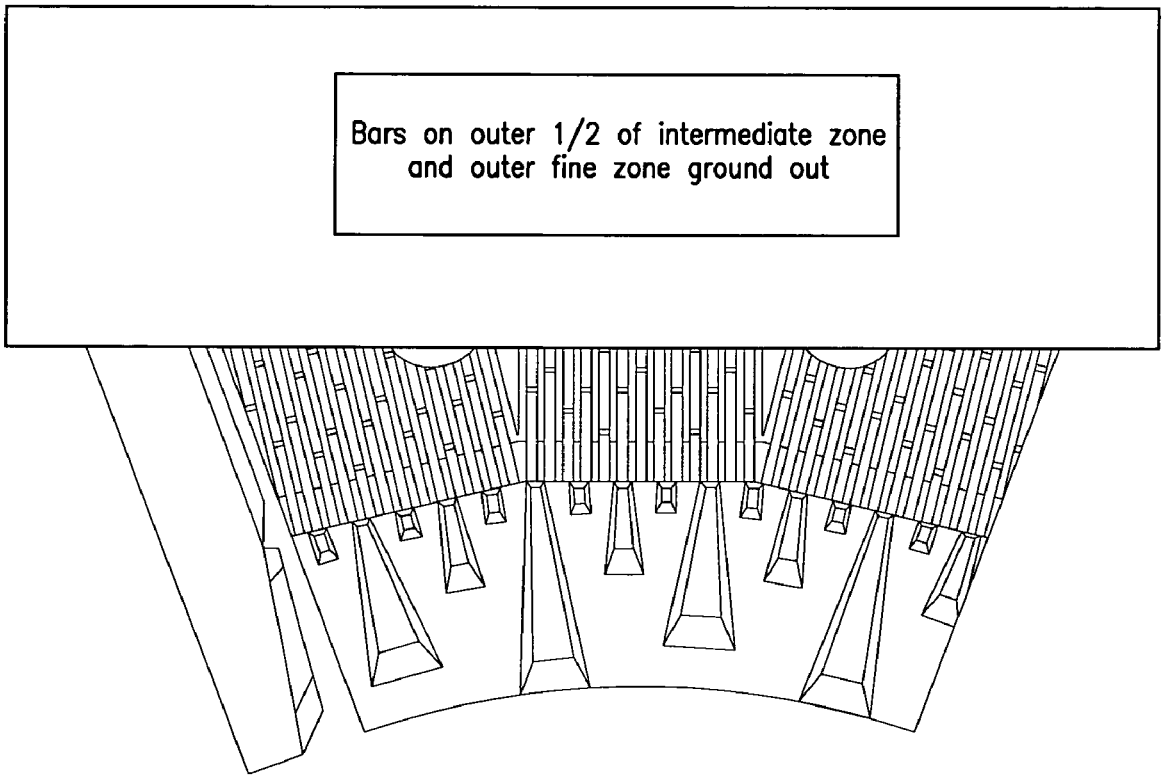
FIG. 9 is a schematic of the plate used in laboratory experiments to model and obtain measurements of the operational characteristics inner fiberizing plate.
Figure 10:
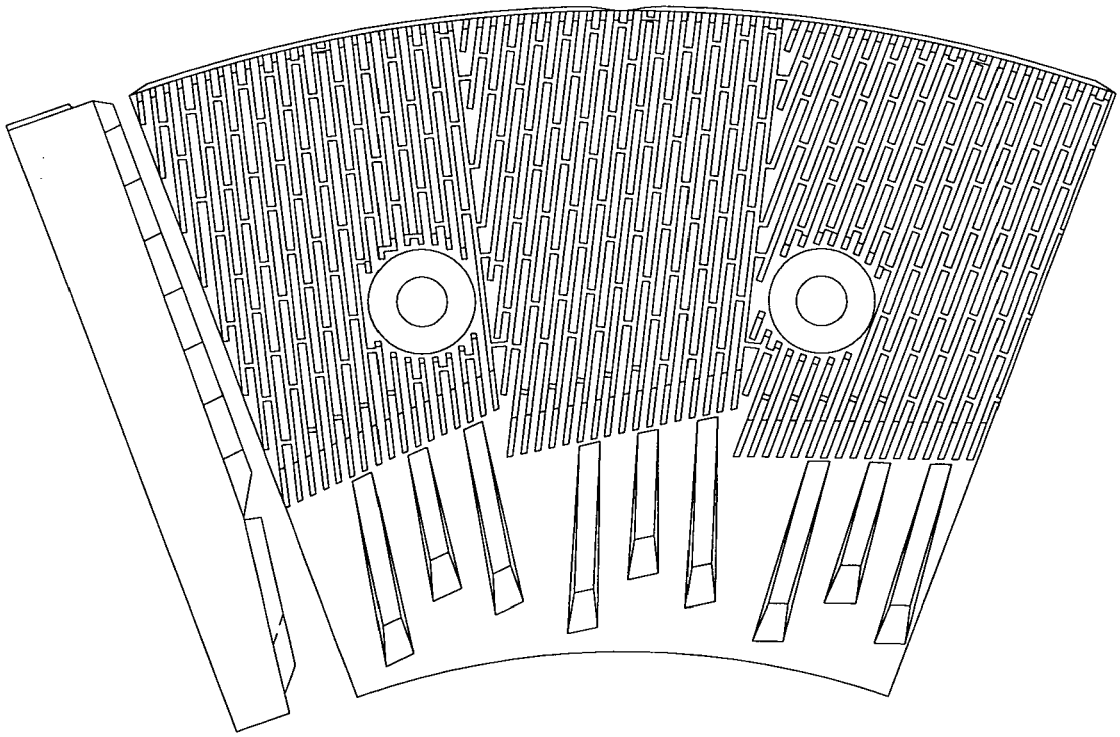
FIG. 10 is a schematic of the plate used in laboratory experiments to model and obtain measurements of the operational characteristics outer, fibrillating plate.

The combination of fiberizing inner rings and high-efficiency outer rings is therefore an important component of this process. The optimization of this process was conducted by running an Andritz pressurized 36-1CP single disc refiner in two steps, firstly using only inner plates and secondly using only the outer plates. For the inner plates, a special Durametal D14B002 three zone refiner plate was used with ½ of the outer intermediate zone and the entire outer zone ground out (see FIG. 9). The inner ½ of the intermediate zone is used to fiberize the destructured wood chips. For the outer plate, a Durametal 36604 directional refiner plate was used in both feeding (expel) and restraining (holdback) refining configurations (see FIG. 10).

Three refining configurations were run using the fiberizer plate inners to simulate the following process variations:

1. RT [2-3 sec. retention (i), 85 psig, 1800 rpm] ii) See A1 from data tables.
2. RTS [2-3 sec. retention (i), 85 psig, 2300 rpm] ii). See A2 from data tables.

3. TMP [2-3 sec. retention (i), 50 psig, 1800 rpm] iii). See A3 from data tables.

i) Retention from PSD discharge to refiner Inlet.

ii) Steaming Tube Pressure=5 psi, retention=30 seconds.

iii) Steaming Tube Pressure=20 psi, retention=3 minutes.

The precursor used to represent the combination of MPSD destructuring and fiberizing inner plates is f-. Therefore the nomenclature used for the preceding configurations are:

1) f-RT 2) f-RTS 3) f-TMP

The fiberized (f) material was then refined using the refiner plate outers at similar respective conditions of pressure and refiner speed i.e.

1) f-RT outers: 85 psig, 1800 rpm 2) f-RTS outers: 85 psig, 2300 rpm 3) f-TMP outers: 50 psig, 1800 rpm The majority of the specific energy was applied during the refiner outer runs. Different conditions of refiner plate direction (expel and holdback) and applied power were evaluated during the outer runs in this investigation.

Each of the primary refined pulps was then refined in a secondary atmospheric Andritz 401 refiner at three levels of applied specific energy.

Control TMP series were also produced without destructuring of the wood chips in the PMSD. This was accomplished by decreasing the production rate of the inners control run from 24.1 ODMTPD to 9.4 ODMTPD. This effectively reduced the plug of chips in the PMSD. The plates were backed off during the control inners run such that size reduction was accomplished using only the breaker bars i.e., no effective refining action by the refiner fiberizing bars following the breaker bars. The inners chips were then refined in the 36-1CP refiner using the outers plates. The primary refined pulps were then refined in the Andritz 401 refiner at several levels of specific energy.

TABLE A presents the nomenclature for each of the refiner series produced in this trial study. The corresponding sample identifications are also presented.

TABLE A

| | Sample Identification | | |
|---|---|---|---|
| Nomenclature * | Primary Inners | Primary Outers | Secondary |
| f-RT 1800 hb 485 ml | A1 | A4 | A7, A8, A9 |
| f-RT 1800 ex 663 ml | A1 | A5 | A10, A11, A12 |
| f-RT 1800 ex 661 ml | A1 | A6 | A13, A14, A15 |
| f-RT 1800 ex 460 ml | A1 | A16 | A22, A23, A24 |
| f-RT 1800 ex 640 ml (2.8% $NaHSO_3$) | A1 | A17 | A25, A26, A27 |
| f-RT 1800 hb 588 ml | A1 | A18 | A28, A29, A30 |
| f-RTS 2300 ex 617 ml | A2 | A19 | A31, A32, A33 |
| f-RTS 2300 ex 538 ml (3.1% $NaHSO_3$) | A2 | A20 | A34, A35, A36 |
| f-TMP 1800 ex 597 ml | A3 | A21 | A37, A38, A39 |
| f-TMP 1800 hb 524 ml | A3 | A41 | A46, A47, A48 |
| TMP 1800 hb 664 ml | A3-1 | A44 | A54, A55, A56, A57, A58 |
| TMP ** 1800 hb 775 ml | A3-1 | A43 | A49, A50, A51, A52, A53 |

* Nomenclature = process, 1ry refiner speed (1800 rpm or 2300 rpm), 1ry outers configuration (ex or hb), 1ry refined freeness

** No good since primary refiner freeness was too high.

The refiner series produced with the primary outers in holdback had a larger plate gap and higher long fiber content than the respective series produced using expelling outers. This permitted refining the holdback series to lower primary freeness levels while retaining the long fiber content of the pulp.

FIGS. 11-18 illustrate pulp property results for most of the refiner series produced in this investigation. The two series produced at very low primary freeness (<500 ml) are excluded from the plots due to congestion.

Figure 11:
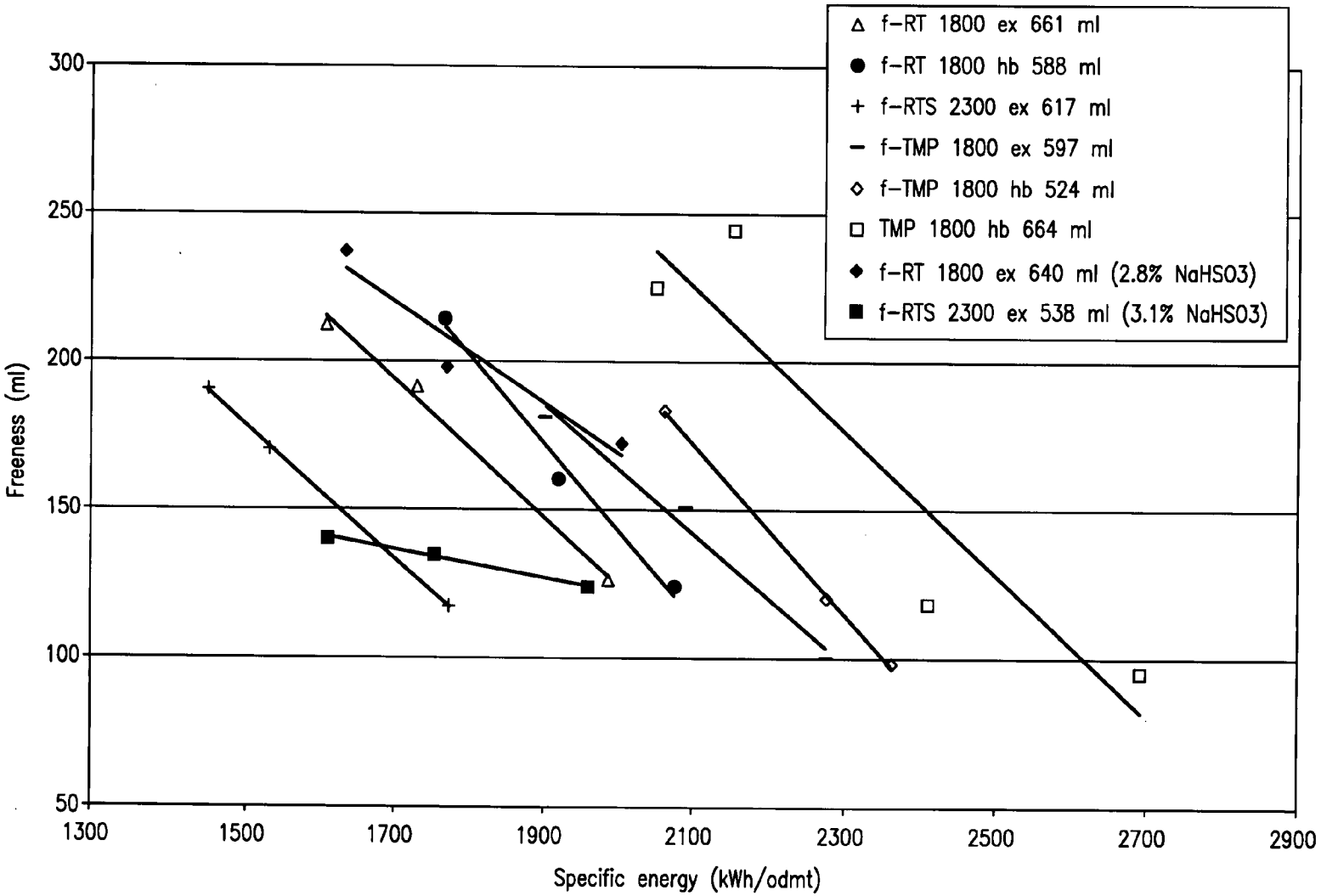
FIGS. 11-18 illustrate pulp property results for most of the refiner series produced in this investigation.

FIG. 11. Freeness Versus Specific Energy

The control TMP series had the highest specific energy requirements to a given freeness. The f-TMP series had the next highest energy requirements followed by the f-RT series. The f-RTS series had the lowest specific energy requirements to a given freeness.

TABLE B compares the specific energy requirements for each of the plotted refiner series at a freeness of 150 ml. The results are from linear interpolation.

TABLE B

Specific Energy at 150 ml.

| | Specific Energy (kWh/MT) |
|---|---|
| f-RT 1800 ex 661 ml | 1889 |
| f-RT 1800 hb 588 ml | 1975 |
| f-RTS 2300 ex 617 ml | 1626 |
| f-TMP 1800 ex 597 ml | 2060 |
| f-TMP 1800 hb 524 ml | 2175 |
| TMP 1800 hb 664 ml | 2411 |
| f-RT 1800 ex 640 ml (2.8% $NaHSO_3$) | 2111* |
| f-RTS 2300 ex 538 ml (3.1% $NaHSO_3$) | 1411* |

*By extrapolation.

The f-RTS 2300 ex series (combination of fiberizing, RTS, and high intensity plates) had a 32% lower energy requirement than the control TMP series to freeness of 150 ml. The f-RT 1800 hb and f-RT 1800 ex series had 18% and 22%, respectively, lower energy requirements than the control TMP series at 150 ml. The f-TMP hb and f-TMP ex series had 10% and 15%, respectively, lower energy requirements than the control TMP series. The results indicate that rebuilding/replacing the PSD and refiner plates can generate a substantial return on investment for existing TMP systems.

Figure 12:
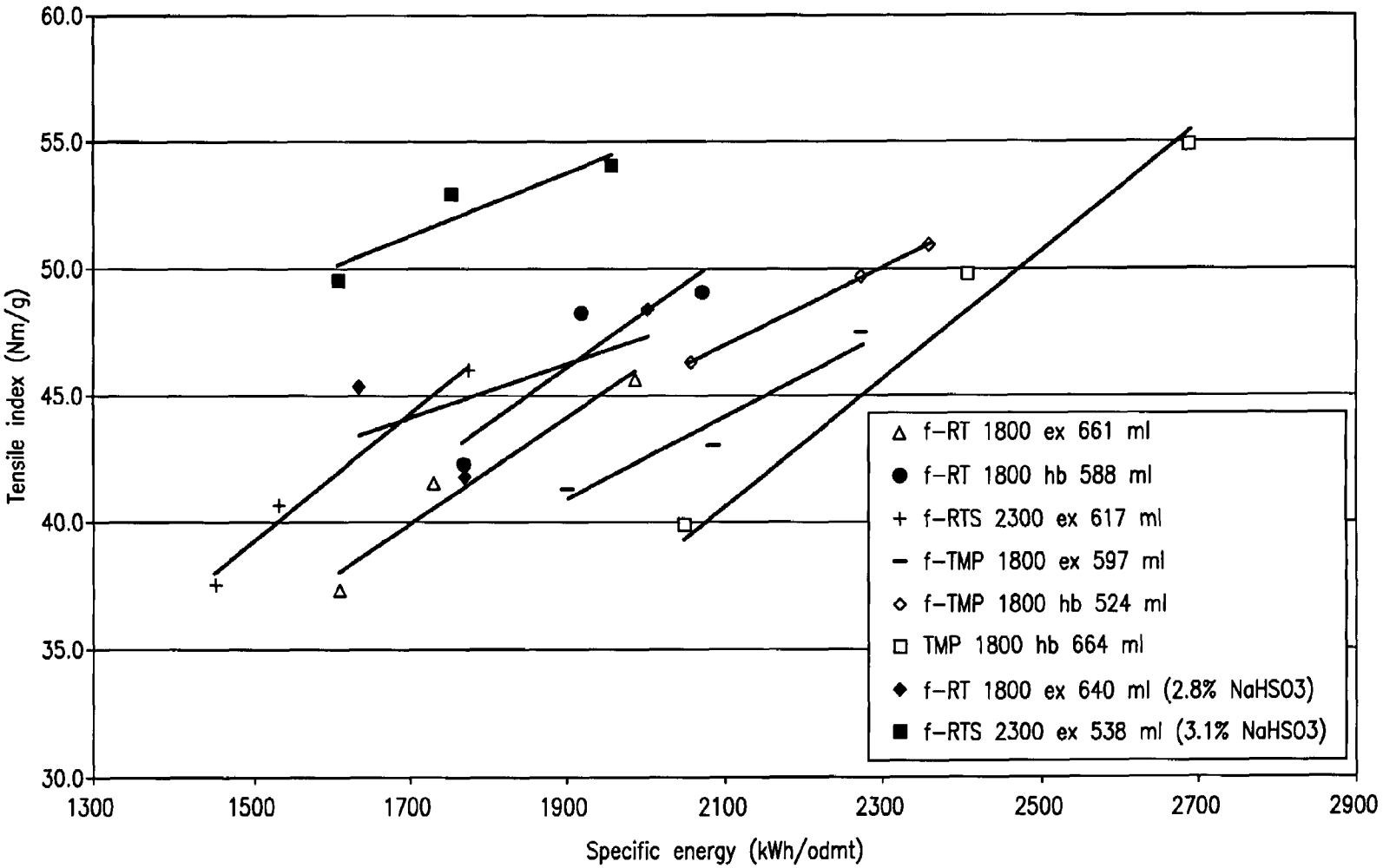

FIG. 12. Tensile Index Versus Specific Energy

The f-RTS ex pulps had the highest tensile index at a given application of specific energy, followed by the f-RT series and then the f-TMP series. The control TMP pulps had the lowest tensile index at a given application of specific energy.

The addition of approximately 3% sodium bisulfite ($NaHSO_3$) solution to the PSD discharge increased the tensile index relative to the respective series without chemical treatment.

A 52.5 Nm/g tensile index was achieved with the f-RTS 2300 ex (3.1% $NaHSO_3$) series with an application of 3.1% $NaHSO_3$ and 1754 kWh/ODMT.

Figure 13:
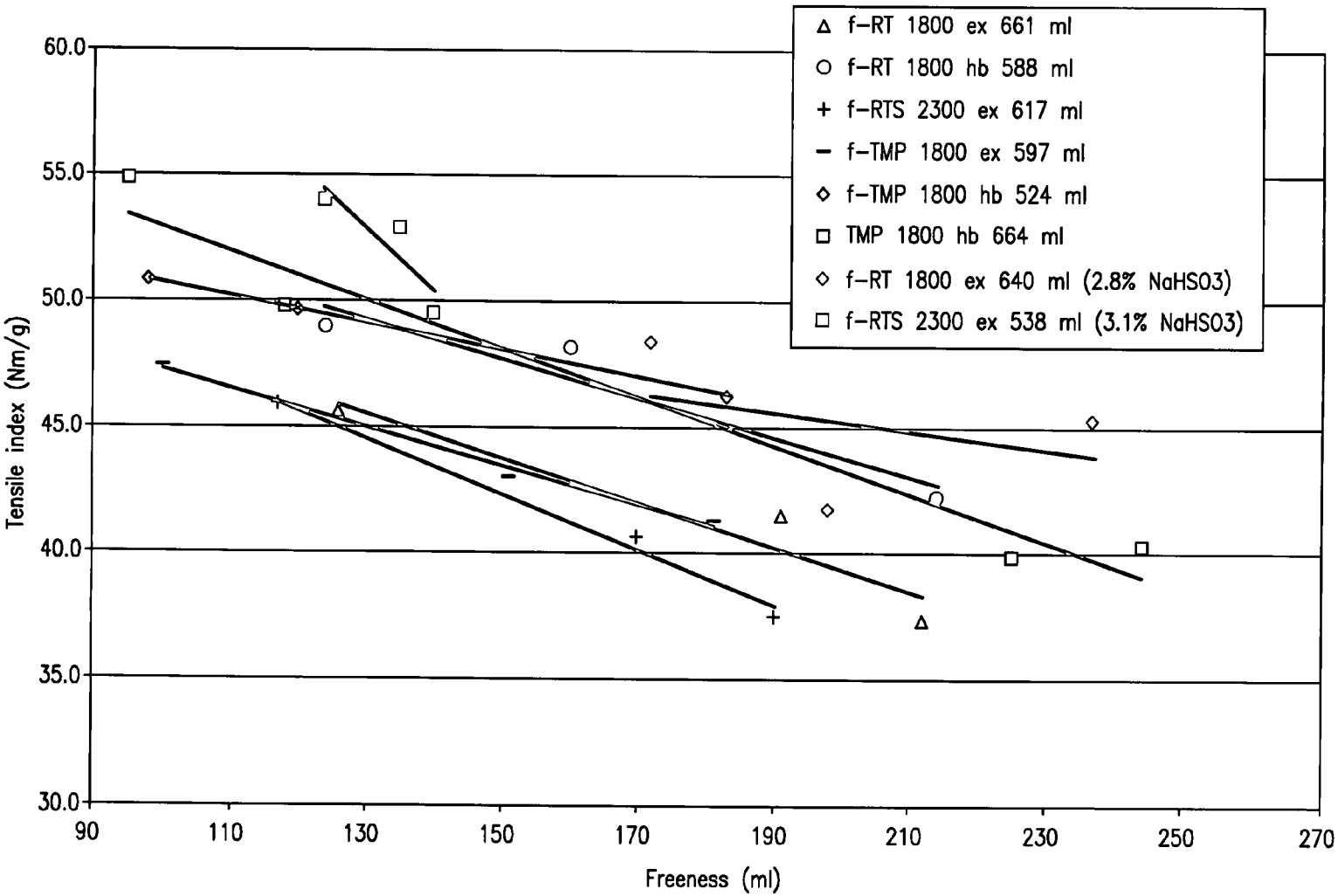

FIG. 13. Tensile Index Versus Freeness

Non-Chemically Treated Series

There were two bands of tensile index results. The lower band represents the series produced using the expelling outer plates. The upper band represents the series produced using the holdback outer plates. The average increase in tensile index using the holdback plates was approximately 10%. It is noted that an f-RTS hb series was not conducted in this trial due to a shortage of fiberized A3 material.

Bisulfite Treated Series

The addition of approximately 3% bisulfite to the f-RT ex and f-RTS ex series elevated the tensile index to a similar or higher level than the holdback pulps.

TABLE C compares each of the refiner series at a freeness of 150 ml. The regression equations used in the interpolations are included on FIG. 13.

TABLE C

Tensile Index at 150 ml

| | Tensile Index (Nm/g) |
|---|---|
| f-RT 1800 ex 661 ml | 43.8 |
| f-RT 1800 hb 588 ml | 47.7 |
| f-RTS 2300 ex 617 ml | 42.4 |
| f-TMP 1800 ex 597 ml | 43.5 |
| f-TMP 1800 hb 524 ml | 48.1 |
| TMP 1800 hb 664 ml | 48.2 |
| f-RT 1800 ex 640 ml (2.8% $NaHSO_3$) | 47.0* |
| f-RTS 2300 ex 538 ml (3.1% $NaHSO_3$) | 47.9* |

*By extrapolation.

Figure 14:
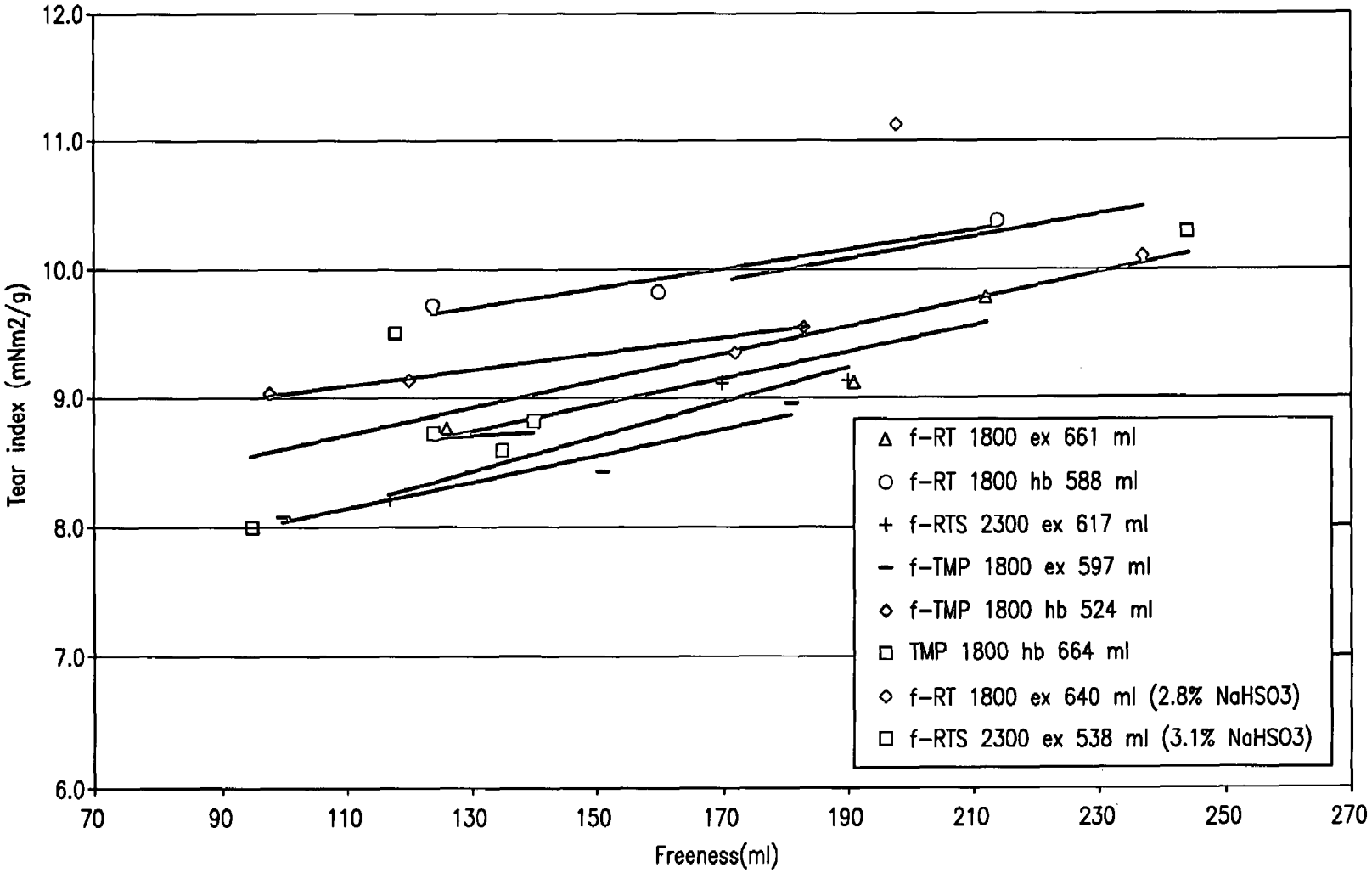
Figure 15:
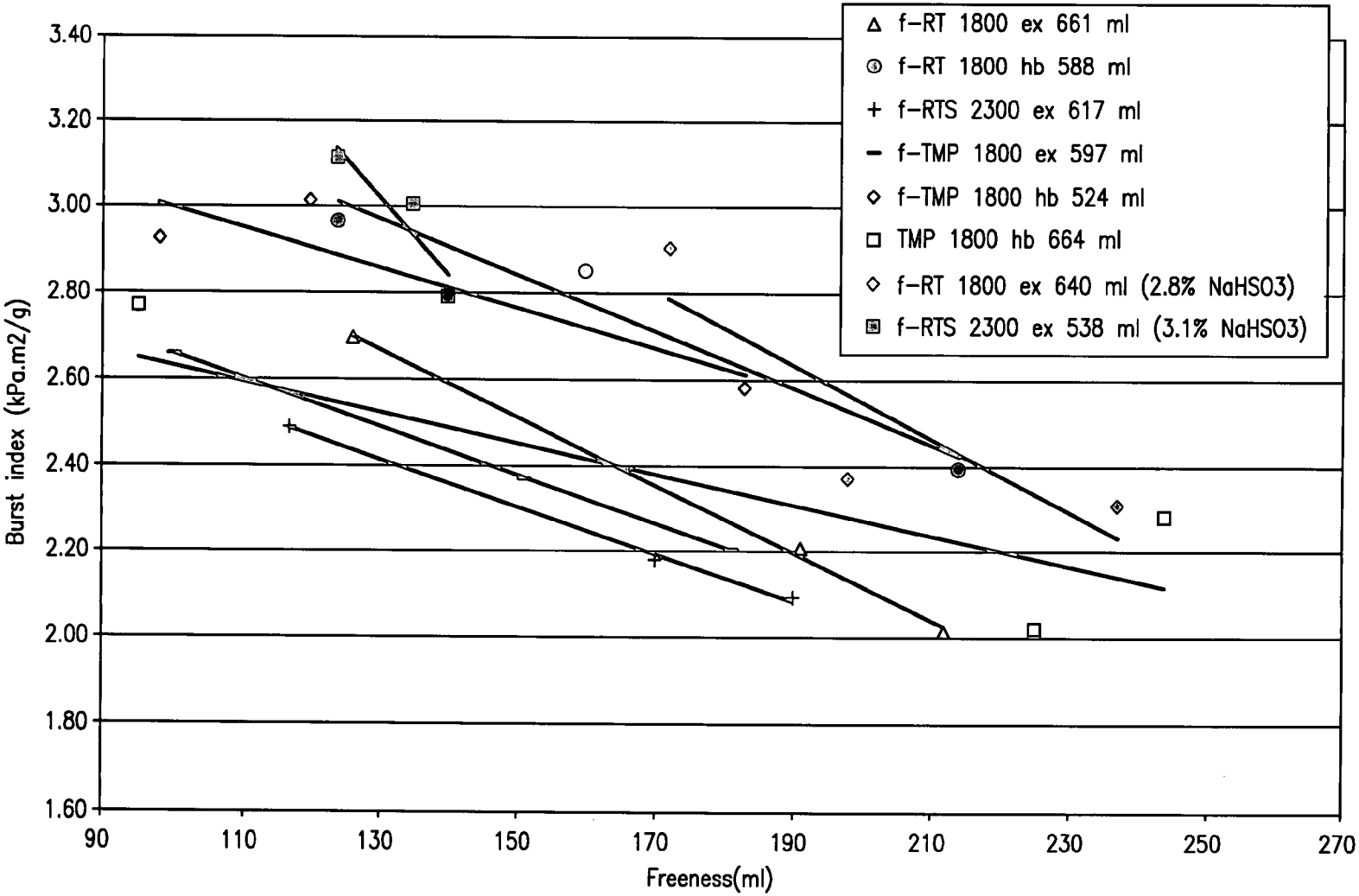

FIG. 14. Tear Index Versus Freeness

The refiner series produced using holdback outer plates had the highest tear index and long fiber content.

TABLE D compares the refiner series at a freeness of 150 ml. The tear index values were obtained using linear interpolation.

TABLE D

Tear Index at 150 ml

| | Tear Index ($mN \cdot m^2/g$) |
|---|---|
| f-RT 1800 ex 661 ml | 9.0 |
| f-RT 1800 hb 588 ml | 9.9 |
| f-RTS 2300 ex 617 ml | 8.7 |
| f-TMP 1800 ex 597 ml | 8.6 |
| f-TMP 1800 hb 524 ml | 9.3 |
| TMP 1800 hb 664 ml | 9.1 |
| f-RT 1800 ex 640 ml (2.8% $NaHSO_3$) * | 9.7 |
| f-RTS 2300 ex 538 ml (3.1% $NaHSO_3$) * | 8.8 |

* By extrapolation.

The f-RT hb pulps had the highest tear index. The f-RT ex and f-RTS ex pulps had comparable tear index results FIG. 15. Burst Index Versus Freeness The f-RT 1800 hb and f-TMP 1800 hb series produced with holdback outer plates had the highest burst index at a given freeness. The refiner series produced with expelling outer plates, f-RT 1800 ex, f-TMP 1800 ex, f-RTS 2300 ex, had a lower burst index at a given freeness.

The addition of approximately 3% bisulfite increased the burst index of the series produced with expelling outer plates to a similar level as the non-chemically treated series produced with holdback outer plates.

TABLE E compares the burst index results interpolated to a freeness of 150 ml.

TABLE E

Burst Index at 150 ml

| | Burst Index ($kPa \cdot m^2/g$) |
|---|---|
| f-RT 1800 ex 661 ml | 2.51 |
| f-RT 1800 hb 588 ml | 2.85 |
| f-RTS 2300 ex 617 ml | 2.30 |
| f-TMP 1800 ex 597 ml | 2.38 |
| f-TMP 1800 hb 524 ml | 2.76 |
| TMP 1800 hb 664 ml | 2.45 |
| f-RT 1800 ex 640 ml (2.8% $NaHSO_3$) * | 2.98 |
| f-RTS 2300 ex 538 ml (3.1% $NaHSO_3$) * | 2.67 |

* By extrapolation.

Figure 16:
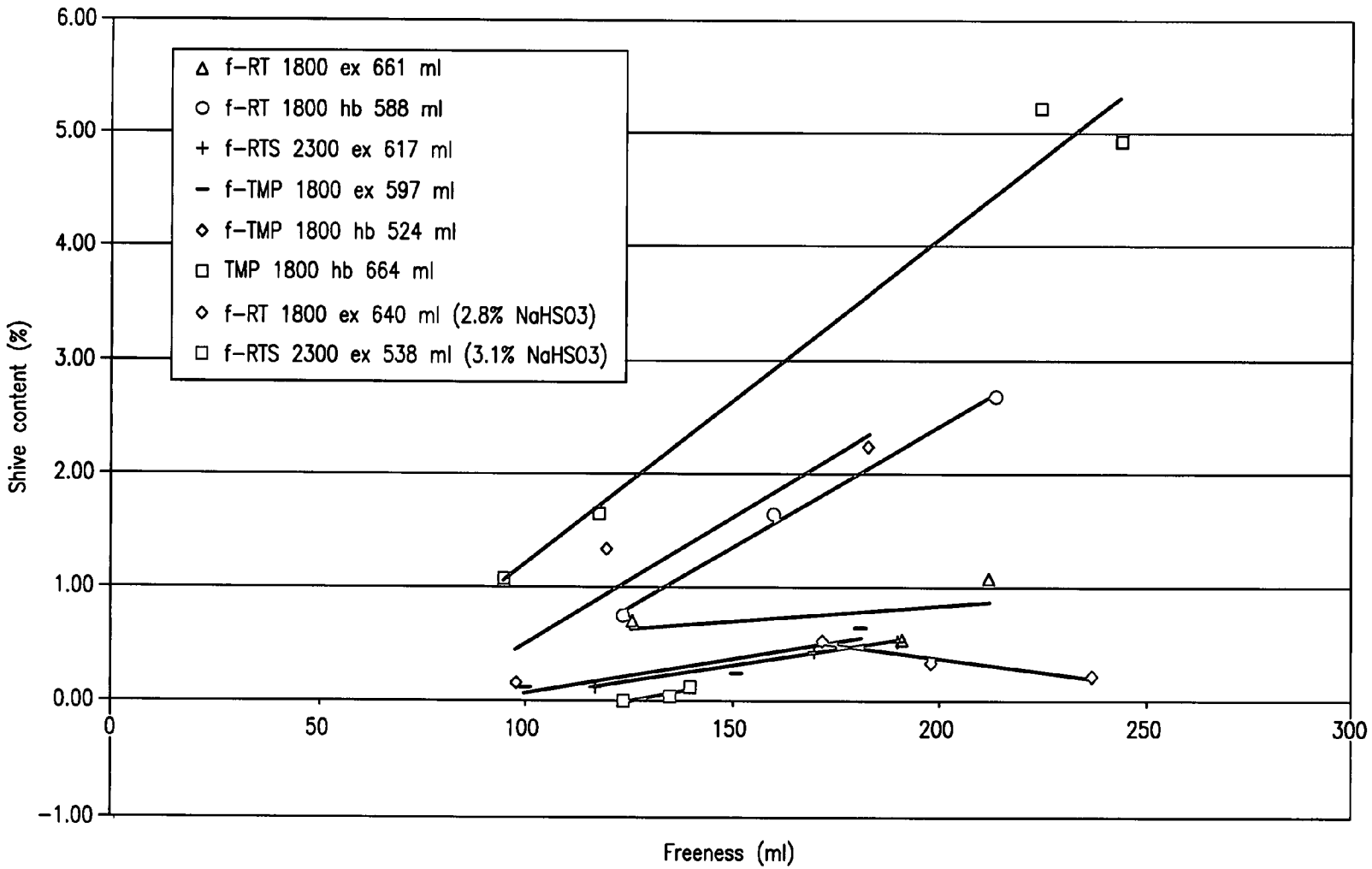

FIG. 16. Shive Content Versus Freeness

The control TMP pulps had the highest shive content levels. The refiner series produced with the expelling outer plates had lower shive content levels than the respective series produced with holdback outer plates. It was clearly evident that the f-pretreatment helps reduce shive content.

TABLE F compares the shive content levels for each refiner series interpolated to a freeness of 150 ml.

TABLE F

Shive Content at 150 ml.

| | Shive Content (%) |
|---|---|
| f-RT 1800 ex 661 ml | 0.70 |
| f-RT 1800 hb 588 ml | 1.35 |
| f-RTS 2300 ex 617 ml | 0.31 |
| f-TMP 1800 ex 597 ml | 0.37 |
| f-TMP 1800 hb 524 ml | 1.61 |
| TMP 1800 hb 664 ml | 2.63 |
| f-RT 1800 ex 640 ml (2.8% $NaHSO_3$) * | 0.59 |
| f-RTS 2300 ex 538 ml (3.1% $NaHSO_3$) * | 0.18 |

* By extrapolation.

The f-RTS ex series produced with and without bisulfite addition had the lowest shive content levels. The addition of bisulfite lowered the shive content.

Figure 17:
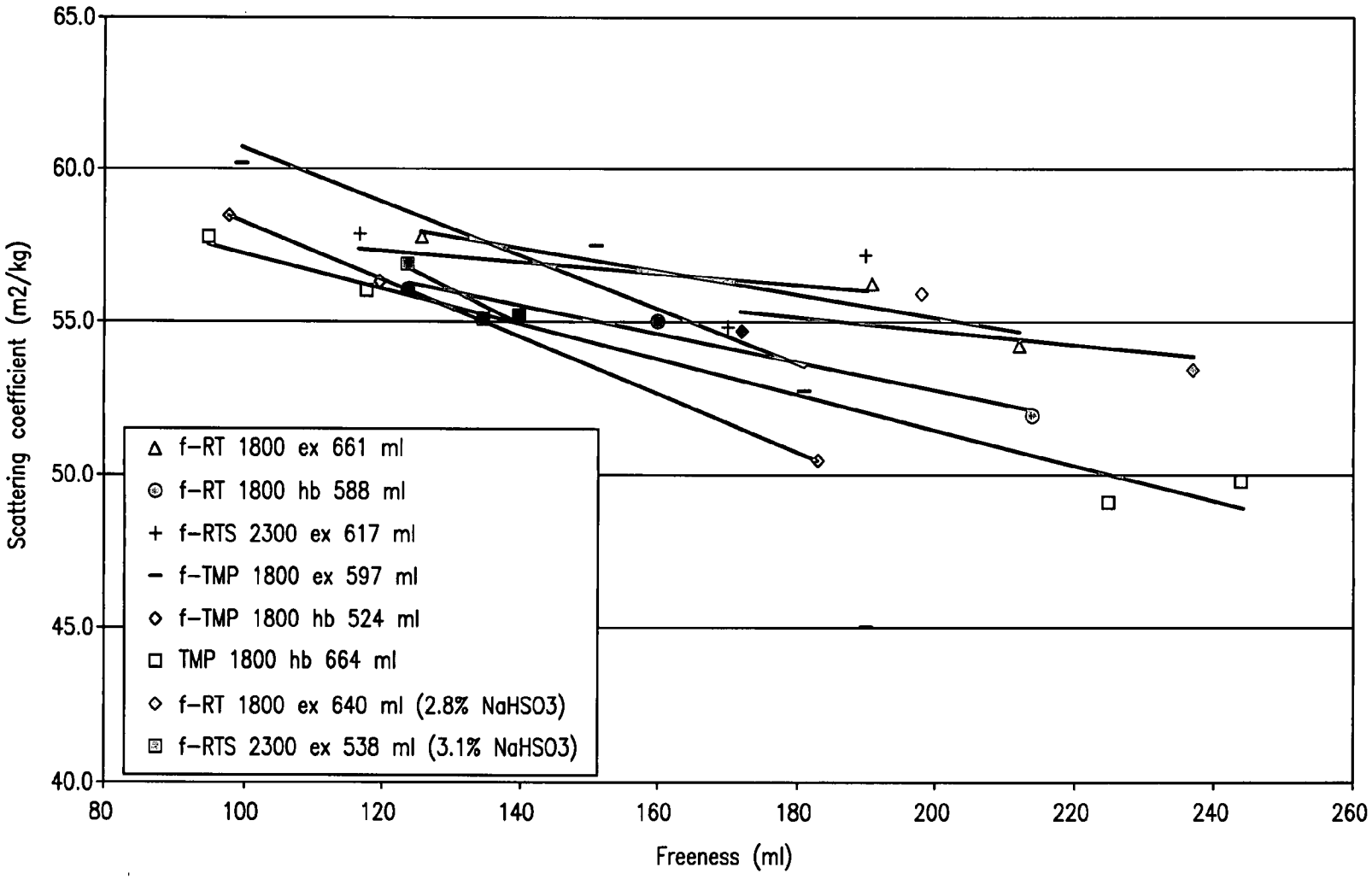

FIG. 17. Scattering Coefficient Versus Freeness

The refiner series produced with the expelling outer plates had the highest scattering coefficient levels.

TABLE G presents the scattering coefficient results for each series at a freeness of 150 ml.

TABLE G

Scattering Coefficient versus Freeness

| | Scattering Coefficient ($m^2/kg$) |
|---|---|
| f-RT 1800 ex 661 ml | 57.1 |
| f-RT 1800 hb 588 ml | 55.1 |
| f-RTS 2300 ex 617 ml | 56.8 |
| f-TMP 1800 ex 597 ml | 56.3 |
| f-TMP 1800 hb 524 ml | 53.6 |
| TMP 1800 hb 664 ml | 54.4 |

TABLE G-continued

Scattering Coefficient versus Freeness

| | Scattering Coefficient ($m^2$/kg) |
|---|---|
| f-RT 1800 ex 640 ml (2.8% $NaHSO_3$) * | 55.9 |
| f-RTS 2300 ex 538 ml (3.1% $NaHSO_3$) * | 53.8 |

* By extrapolation.

The addition of approximately 3% bisulfite reduced the scattering coefficient by approximately 1-3 $m^2$/kg.

Figure 18:
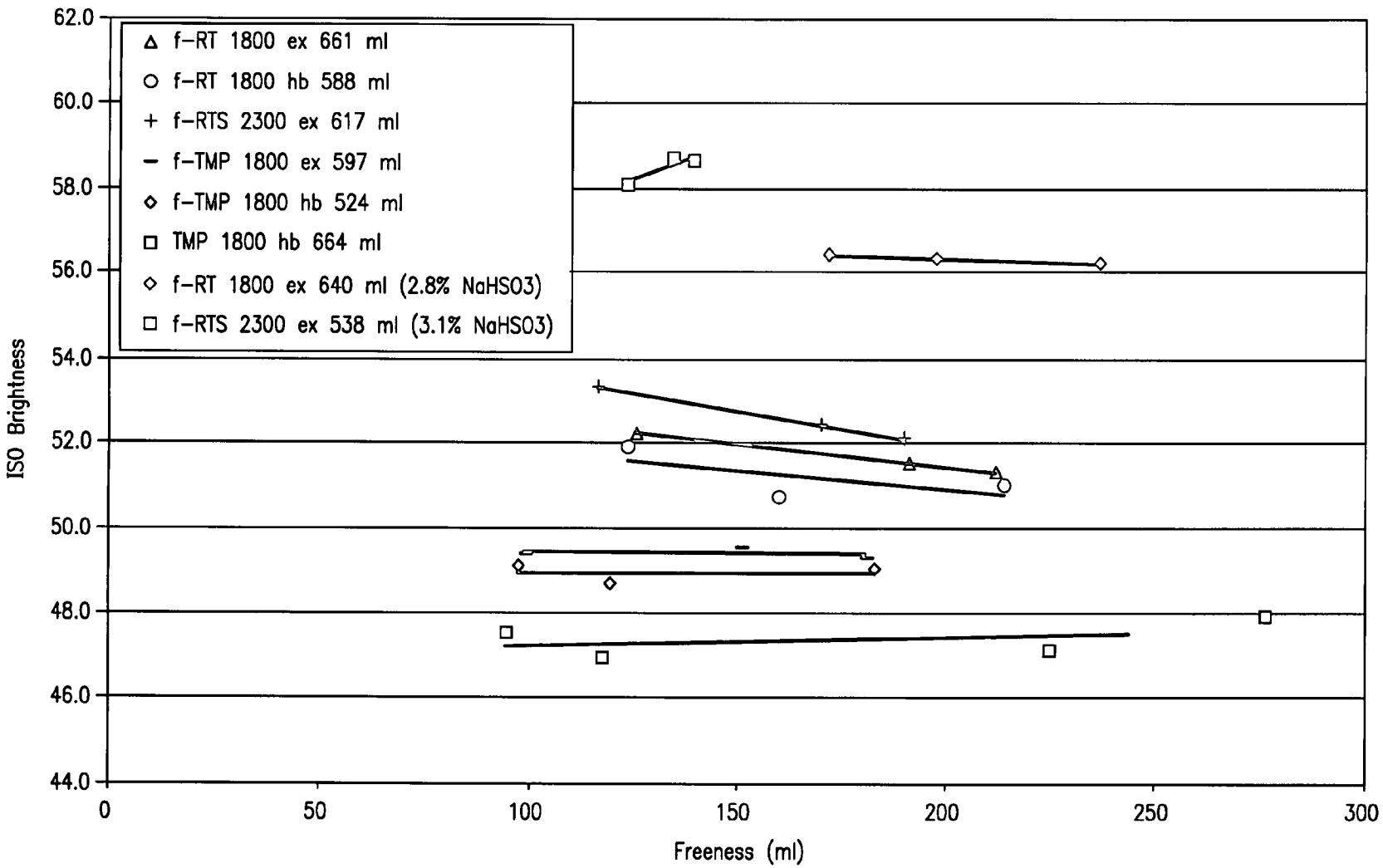

FIG. 18. Brightness Versus Freeness

All the f-series had higher brightness than the control TMP pulps.

TABLE H compares each of the refiner series interpolated to a freeness of 150 ml.

TABLE H

ISO Brightness at 150 ml

| | ISO Brightness |
|---|---|
| f-RT 1800 ex 661 ml | 52.0 |
| f-RT 1800 hb 588 ml | 51.3 |
| f-RTS 2300 ex 617 ml | 52.8 |
| f-TMP 1800 ex 597 ml | 49.4 |
| f-TMP 1800 hb 524 ml | 48.9 |
| TMP 1800 hb 664 ml | 47.3 |
| f-RT 1800 ex 640 ml (2.8% $NaHSO_3$) * | 56.5 |
| f-RTS 2300 ex 538 ml (3.1% $NaHSO_3$) * | 59.1 |

* By extrapolation.

The f-TMP series had approximately 2% higher brightness than the control TMP series. A higher removal of wood extractives from the high compression PSD component of the f-pretreatment most probably contributed to the brightness increase.

The f-RTS series had the highest brightness (52.8) followed by the f-RT series (average=51.7), then the f-TMP series (average=49.2).

The addition of 3% bisulfite increased the brightness considerably, up to 59.1 with the f-RTS ex series.

3. Comparing Defibration Conditions During Inner Zone Refining

TABLE I compares the fiberized properties following the inner plates. As indicated earlier, three fiberizer runs, A1, A2, A3 were conducted to simulate the f-RT, f-RTS and f-TMP configurations. Each of these inner ring runs was fed with destructured chips from the PSD.

TABLE I

Fiberized Properties following Inner Rings

| Fiberizer (f-) Run | Process | Pressure (psi) | Throughput (ODMTPD) | Specific Energy (kWh/ODMT) | Shive Content (%) | +28 Mesh (%) |
|---|---|---|---|---|---|---|
| A1 | RT | 85 | 23.3 | 152 | 66.5 | 75.4 |
| A2 | RTS | 85 | 23.3 | 122 | 35.6 | 79.4 |
| A3 | TMP | 50 | 24.1 | 243 | 88.7 | 82.4 |

It is evident that the process conditions have a major impact on the defibration efficiency during inner zone refining. The destructured chips refined at higher pressure (A1, A2) had a significantly lower shive content (=more defibrated fibers) compared to refining at a typical TMP pressure (50 psi). The energy requirement for defibration was also lower at high pressure. The highest defibration level was obtained when combining high pressure and high speed (A2).

The A2 (f-RTS) material demonstrated the highest fiber separation, followed by the A1 (f-RT) material. The A3 (f-TMP) was clearly the coarsest of the fiberized samples.

It is noted that bar directionality was not a factor during the inner zone refining runs since the inner plates were bidirectional.

The energy for defibration decreases with an increase in pressure. The energy losses are quite substantial when defibrating at conventional conditions. For example, at a pressure of 50 psig, an additional specific energy requirement of well over 100 kWh/MT would be necessary when producing fiberized material to the same shives level as compared to refining at 85 psig.

4. Laboratory Procedures

White spruce chips from Wisconsin were used for these examples. Material identification, solids content and bulk density for the spruce chips appear in TABLE II.

Initially, several runs were carried out on the 36-1CP pressurized variable speed refiner utilizing plate pattern D14B002 with the outer zone and ½ intermediate zone ground out. This was conducted to simulate the inner rings of larger single disc refiners. The first run A1 was produced with 30-second presteam retention in the steaming tube at 0.4 bar, 5.87 bar refiner casing pressure, and a machine speed of 1800 rpm. For A2, the machine speed was increased to 2300 rpm. The A3 run was produced with 3 minutes presteam retention at 1.38 bar, 3.45 bar refiner casing pressure, and refiner disc speed of 1800 rpm. Run A3-1 was also conducted at similar conditions as A3, except the production rate was decreased from 24.1 ODMTPD to 9.4 ODMTPD in order to prevent destructuring of the chips prior to feeding the refiner. The plate gap for this run was also increased to eliminate any effective action by the intermediate bar zone, such that the chips received breaker bar treatment only. Fiber quality analysis was not possible on sample A1-1 since chips receiving breaker bar treatment only are not in a fiberized form; therefore shive or Bauer McNett analysis is not applicable.

Each of these pulps was used to produce additional series. Six series were carried out on the A1 material. The outer plates (Durametal 36604) were installed in the 36-1CP refiner to simulate the outer zone of refining. All six primary outer zone runs were refined on the 36-1CP at 5.87 bar casing pressure and at a disc speed of 1800 rpm. The process nomenclature for these runs is RT. A sodium bisulfite liquor was added to A17 resulting in a chemical charge of 2.8% $NaHSO_3$ (on O.D. wood basis). Three secondary refiner runs were produced on each series.

Two series were produced on the A2 material. Both 36-1CP outer zone runs produced (A19 and A20) were produced at 5.87 bar refiner casing pressure and 2300 rpm machine speed. The process nomenclature for these runs is RTS. Sodium bisulfite liquor was added to A20 (3.1% $NaHSO_3$). Again three secondary refiner runs were produced on each.

Several series were also produced on the A3 material, each at 3.45 bar refiner casing pressure and 1800 rpm. Three secondary refiner runs were produced on each. The process nomenclature for these runs is TMP.

Two control TMP series were produced (A43 and A44) on the A3-1 chips, which went through breaker bar treatment only during inner zone refining. Both A43 and A44 were refined at 3.45 bar steaming pressure and 1800 rpm machine speed. Several atmospheric refiner runs were then conducted on these pulps to decrease the freeness to a comparable range as the earlier produced series.

All pulps were tested in accordance with standard Tappi procedures. Testing included Canadian Standard Freeness, Pulmac Shives (0.10 mm screen), Bauer McNett classifications, optical fiber length analyses, physical and optical properties.

TABLE I-A

GRAPHIC RUN SUMMARY

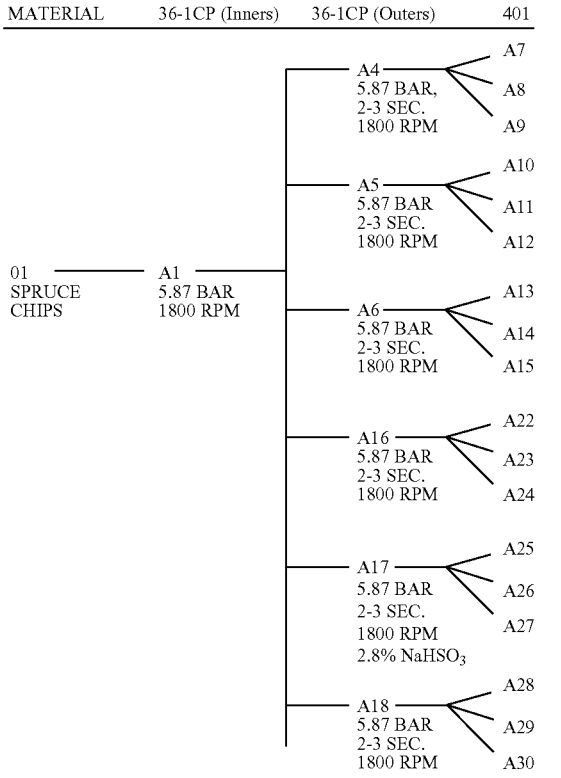

NOTE:

A1 USED D14B002 PLATES- OUTER TAPER AND ½ INTERMEDIATE ZONE AND OUTER ZONE GROUND OUT. A1 TUBE PRESSURE OF 0.69 BAR, A4, A5, A6, A16, A17 and A18 TUBE PRESSURE 0.34 BAR. A5, A6, A16 and A17 REFINED IN REVERSE MODE.

TABLE I-B

GRAPHIC RUN SUMMARY

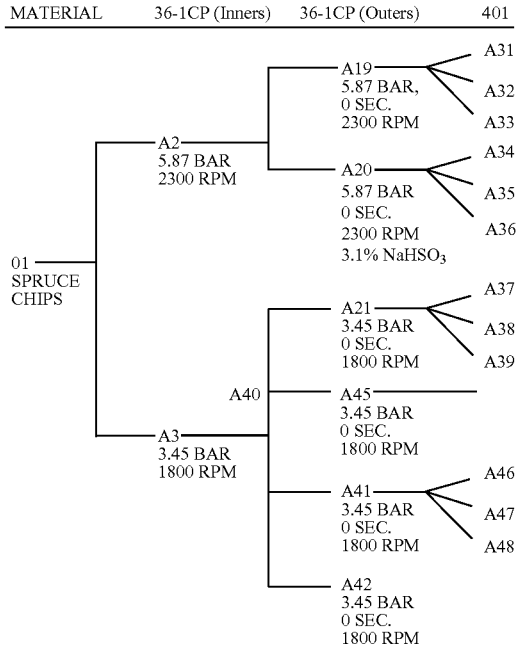

NOTE:

A2 AND A3 USED D14B002 PLATES OUTER TAPER AND ½ INTERMEDIATE ZONE AND OUTER ZONE GROUND OUT. A2 TUBE PRESSURE OF 0.69 BAR, A3 TUBE PRESSURE 1.38 BAR. A19, A20, A21, A40, A41 and A42 TUBE PRESSURE 0.34 BAR. A19, A20, A21 REFINED IN REVERSE MODE.

TABLE I-C

GRAPHIC RUN SUMMARY

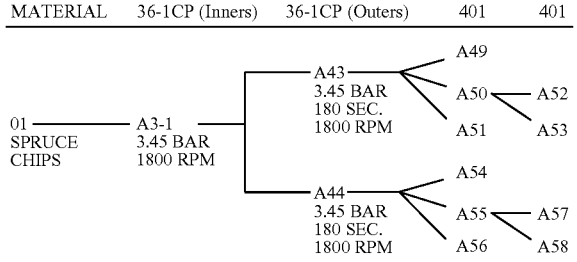

TABLE II

MATERIAL IDENTIFICATION

| | MATERIAL | % O.D. SOLIDS | BULK DENSITY ($kg/m^3$) WET | BULK DENSITY ($kg/m^3$) DRY |
|---|---|---|---|---|
| 01 | SPRUCE | 66.5 | 169.8 | 112.9 |
| | SOAKED | 47.7 | | |

What is claimed is:

1. A system for producing thermomechanical pulp in a rotating disc refiner from wood chips that have been steamed, comprising:

a pressurized macerating screw device having an inlet end for receiving the steamed chips, a working section for subjecting the chips to maceration and dewatering under high mechanical compression forces in an environment of saturated steam to destructure the chips, and a discharge end where the dewatered and destructured chips expand;

means at the discharge end of the screw device, for introducing dilution water into the dewatered and destructured chips, whereby the dilution water penetrates the expanding chips and together with the chips forms a refiner feed material having a solids consistency in the range of about 30 to 55 percent;

a primary refiner having relatively rotating discs each having a working plate thereon, the working plates being arranged in confronting coaxial relation thereby defining a refiner gap which extends substantially radially outward from the inner diameter of the discs to the outer diameter of the discs;

each plate having a radially inner fiberizing ring and a radially outer fibrillating ring, each ring having an inner feeding region and an outer working region, wherein the working region of the inner ring is defined by a first pattern of alternating bars and grooves, and the feeding region of the outer ring is defined by a second pattern of alternating bars and grooves, said first pattern on the working region on the inner ring having relatively narrower grooves than the grooves of said second pattern on the feeding region on the outer ring; and a refiner feed device for receiving the feed material and delivering the feed material between the discs at substantially the inner diameter of the discs.

wherein the working section of the pressurized macerating screw includes a dewatering portion, having a perforated tubular wall and a flighted coaxial shaft of uniform diameter rotatable therein, and a plug portion immediately following the dewatering portion, having a solid tubular wall and an unlighted shaft of greater diameter than in the dewatering portion, thereby defining a constricted flow cross section for macerating the chips under high compression; and wherein the discharge end of the pressurized macerating screw includes an expansion wall that outwardly flares from the solid tubular wall of the plug portion and a conical valve coaxial with the shaft and confronting the expansion wall in axially adjustable spaced relation, thereby defining an adjustable expansion volume.

2. The system of claim 1, wherein the means for introducing dilution water includes at least one fluid nozzle penetrating the flared expansion wall for introducing dilution water into said adjustable expansion volume.

3. The system of claim 1, wherein the means for introducing dilution water includes at least one fluid nozzle penetrating the conical valve for introducing dilution water into said adjustable expansion volume.

4. The system of claim 1, wherein the working region of outer ring has a third pattern of alternating bars and grooves, and the grooves in the third pattern of the outer ring are narrower than the grooves in the first pattern of the working region of the inner ring.

5. The system of claim 1, including an annular space between the inner ring and the outer ring.

6. The system of claim 5, wherein some but not all of the bars in the feed region of the outer ring extend into said annular space.

7. The system of claim 1, wherein the inner ring and the outer ring are distinct members attached to a common refiner disc.

8. The system of claim 1, wherein the inner ring and the outer ring are integrally formed on a common base.

9. The system of claim 1, wherein each plate has a total radius extending to the outer circumference of the outer ring and each ring has a respective radial width, and the radial width of the inner ring is less then the radial width of the outer ring.

10. The system of claim 9, wherein the radial width of the inner ring is less than about 35% of said total radius.

11. The system of claim 9, wherein the radial width of the feed region of the inner ring is larger than the radial width of the working region of the inner ring, and the radial width of the feed region in the outer ring is less than the radial width of the working region of the outer ring.

12. The system of claim 9, wherein the pattern of bars and grooves in the working region of the outer ring has at least two zones, one of said zones contiguous with the feed region of the outer ring and another of said zones contiguous with the outer circumference of said outer ring; and the pattern of bars and grooves in said one zone is less dense than the pattern of bars and grooves in said other zone.

13. The system of claim 12, wherein the pattern of bars and grooves throughout the working region of the inner ring has a uniform density.

14. The system of claim 1, wherein the pattern of bars and grooves throughout the working region of the inner ring has a first uniform density and the pattern of bars and grooves throughout the feed region of the outer ring has a second uniform density.

* * * * *